US007870760B2

(12) United States Patent
Hirano et al.

(10) Patent No.: US 7,870,760 B2
(45) Date of Patent: Jan. 18, 2011

(54) KNITTING ELEMENT WITH ROTOR AND KNITTING MACHINE

(75) Inventors: Hideo Hirano, Nara (JP); Kousuke Noguchi, Nara (JP)

(73) Assignee: Okamoto Corporation, Koryo-Cho, Kitakatsuragi-Gun, Nara (JP)

( * ) Notice: Subject to any disclaimer, the term of this patent is extended or adjusted under 35 U.S.C. 154(b) by 0 days.

(21) Appl. No.: 12/541,197

(22) Filed: Aug. 14, 2009

(65) Prior Publication Data

US 2010/0126228 A1 May 27, 2010

(30) Foreign Application Priority Data

Nov. 26, 2008 (JP) ..... 2008-301119

(51) Int. Cl.
*D04B 35/00* (2006.01)

(52) U.S. Cl. ..... 66/1 R

(58) Field of Classification Search ..... 66/1 A, 66/1 R, 116, 123, 3
See application file for complete search history.

(56) References Cited

U.S. PATENT DOCUMENTS 393,766 A * 12/1888 Kohler et al. ..... 112/201
421,526 A * 2/1890 Schmitt ..... 66/1 R
859,423 A * 7/1907 Ammerman ..... 112/168
2,442,412 A * 6/1948 Holmes et al. ..... 66/14
3,971,232 A * 7/1976 Darling ..... 66/1 R
3,982,409 A * 9/1976 Conroux et al. ..... 66/1 R
4,034,577 A * 7/1977 Puthon ..... 66/1 R
4,546,622 A * 10/1985 Seidel et al. ..... 66/9 B
5,775,135 A * 7/1998 Shibata et al. ..... 66/219

FOREIGN PATENT DOCUMENTS

FR 2 389 699 12/1978
GB 2077305 A * 12/1981
JP 51-072670 6/1976

OTHER PUBLICATIONS

EP Communication, European Search Report, EP 09 00 7714, Mar. 2, 2010, a total of 6 pages.
Japanese Office Action, Japanese Patent Application No. 2008-301119, Date: Sep. 21, 2010, pp. 1-2.

* cited by examiner

*Primary Examiner*—Danny Worrell
(74) *Attorney, Agent, or Firm*—Squire, Sanders & Dempsey, LLP

(57) ABSTRACT

The knitting element has a rotor capable of rotating about an axis and makes a stitch by using rotational motion of the rotor. The knitting element has a rotor having a rotating shaft which protrudes in the direction of the axis and a bearing which slidably supports the circumferential face of the rotating shaft. An engagement recess capable of engaging knitting yarn is formed in the circumferential face of the rotor.

15 Claims, 37 Drawing Sheets

(A)

(B)

(C)

(A)

(B)

(C)

(D)

(E)

(F)

KNITTING ELEMENT WITH ROTOR AND KNITTING MACHINE

BACKGROUND OF THE INVENTION

1. Field of the Invention

The present invention relates to a knitting element which comprises a rotor and makes a stitch by using the rotational motion of the rotor, to a knitting machine comprising the knitting element, to a rotor for a knitting element, and to a knitting method.

2. Related Background Art

A rotary knitting machine which makes a stitch by causing a circular rotor to rotate and using the rotational motion of the rotor is conventionally known as technology in this field (See U.S. Pat. No. 3,971,232, for example). In the rotary knitting machine, a hook for engaging a knitting yarn is formed on a circumferential face of a circular rotor main body. In addition, a tooth shape for meshing with a rack which moves linearly is formed on the circumferential face of the rotor main body. Further, the rotor main body is held by a holding guide which slidably holds the circumferential face of the rotor main body and is constituted to rotate in response to the linear motion of the rack. Furthermore, in the rotary knitting machine appearing in U.S. Pat. No. 3,971,232, a plurality of rotors required for a stitch are held by a holding guide with an integral structure.

However, with the prior art appearing in U.S. Pat. No. 3,971,232, because the circumferential face of the rotor main body on which a plurality of irregular shapes are formed, there is the problem that the rotor does not rotate stably. Furthermore, with the prior art appearing in U.S. Pat. No. 3,971,232, because the plurality of rotors which are required for a stitch are held by a holding guide with an integral structure, there is the problem that rotational control of the rotors cannot be performed independently. There is therefore a need for a knitting element which can be applied to a practical knitting machine.

SUMMARY OF THE INVENTION

The present invention was conceived in order to solve this problem and an object of the present invention is to provide a knitting element which allows rotors to rotate stably, which permits independent rotational control of the rotors, and which can be applied to a practical knitting machine, and to provide a knitting machine comprising the knitting element, a rotor for the knitting element, and a knitting method.

A knitting element according to the present invention has a rotor capable of rotating about an axis and makes a stitch by using rotational motion of the rotor, comprising the rotor having a rotating shaft protruding in a direction of the axis; and a bearing supporting a circumferential face of the rotating shaft slidably, wherein an engagement recess capable of engaging knitting yarn is formed in a circumferential face of the rotor.

The knitting element with this constitution is constituted such that the rotor comprises a rotating shaft and the knitting element comprises a bearing which slidably supports the circumferential face of the rotating shaft, thereby allowing the rotor to rotate stably. Consequently, a knitting yarn can be engaged by being made to enter the engagement recess, the rotational motion of the rotor can be utilized, and a loop which is required for a stitch can be suitably formed. The rotating shaft need not be formed rod-shaped (cylindrical) and the length of the rotating shaft in the axial direction may be on the order of the sheet thickness of the rotor main body.

Furthermore, bearings include those which rotatably support the rotating shaft and the length in the direction of the axis includes lengths which rotatably support the rotating shaft which is on the order of the sheet thickness of the rotor main body.

Furthermore, the knitting element of the present invention is constituted as a unit part which is independently separable and is therefore capable of independently controlling a plurality of rotors which are required for a stitch. Since the knitting element is constituted as a unit part, exchanging the knitting element is straightforward and maintenance is simplified.

In addition, the engagement recess is preferably formed facing toward a core of the rotor, a bottom of the engagement recess is preferably formed inside the rotating shaft, and an opening which allows the knitting yarn to enter the bottom of the engagement recess is preferably formed in the bearing. Thus, an opening which allows a knitting yarn to enter the bottom of the engagement recess is formed in the bearing which slidably supports the rotating shaft, whereby the knitting yarn can be introduced to the rotating shaft and the rotor can be suitably rotated while preventing the knitting yarn from catching on the rotating shaft.

Here, a constitution in which a guided portion for causing the rotor to rotate about the axis is formed at the circumferential face of the rotor is preferable. The rotor can thus be made to rotate about the axis line by guiding the guided portion.

Furthermore, a pair of the engagement recesses are preferably formed in positions opposite one another, and a pair of the guided portions are preferably formed opposite one another in positions different from the positions in which the pair of the engagement recesses are formed.

Further, the knitting machine of the present invention comprises a knitting element which has a rotor capable of rotation about a first axis and makes a stitch by using rotational motion of the rotor; and a base having a knitting element holding portion which holds the knitting element, the base causing the knitting element to rotate about a second axis orthogonal to the first axis, wherein the knitting element comprises the rotor having a rotating shaft protruding in a direction of the first axis and a bearing supporting a circumferential face of the rotating shaft slidably, and wherein an engagement recess capable of engaging knitting yarn is formed in a circumferential face of the rotor.

The knitting machine with this constitution is constituted comprising a knitting element in which the rotor comprises a rotating shaft, the knitting element comprising a bearing which slidably supports the circumferential face of the rotating shaft, whereby the rotor can be made to rotate stably. Thus, the knitting yarn can be engaged by being made to enter the engagement recess, the rotational motion of the rotor can be utilized, and a loop which is required for a stitch can be suitably formed.

The engagement recess is preferably formed facing toward a core of the rotor, a bottom of the engagement recess is preferably formed inside the rotating shaft, and an opening which allows the knitting yarn to enter the bottom of the engagement recess is preferably formed in the bearing. Thus, an opening which allows the knitting yarn to enter the bottom of the engagement recess is formed in the bearing which slidably supports the rotating shaft, whereby the knitting yarn can be introduced to the rotating shaft and the rotor can be suitably rotated while preventing the knitting yarn from catching on the rotating shaft.

Here, the knitting machine is preferably constituted comprising a guide portion, disposed so as to correspond to an orbit of the rotor centered on the second axis, the guide portion regulating a rotational position of the rotor about the first axis, wherein a guided portion to be guided by the guide portion is formed at the circumferential face of the rotor. Thus, the rotational position of the rotor about the rotating shaft can be regulated in accordance with the orbit of the knitting element and the rotor can be suitably rotated.

In addition, the guide portion may be a rail protruding toward the rotor, and the guided portion may be a guide recess guided by the rail.

Further, the guide portion may be a groove deepening toward the side opposite to the rotor, and the guided portion may be a guide protrusion guided by the groove.

Furthermore, a pair of the engagement recesses are preferably formed in positions opposite one another, and a pair of the guided portions are preferably formed opposite one another in positions different from the positions in which the pair of the engagement recesses are formed.

Furthermore, a rotor for a knitting element according to the present invention is a rotor for a knitting element which makes a stitch by using rotational motion, comprising a rotor main body wherein an engagement recess capable of engaging knitting yarn is formed in a circumferential face of the rotor main body; and a rotating shaft provided at a core of the rotator main body, the rotating shaft protruding outward.

With the rotor for a knitting element with this constitution, the rotor main body comprises a rotating shaft, and therefore the rotor main body can be rotatably supported and the rotor can be made to rotate stably. Furthermore, because an engagement recess which is able to engage knitting yarn is formed in the circumferential face of the rotor main body, a knitting yarn can be engaged by being made to enter an engagement recess, the rotational motion of the rotor can be utilized, and a loop which is required for a stitch can be suitably formed.

Moreover, the engagement recess is suitably formed facing toward the core, and a bottom of the engagement recess is suitably formed inside the rotating shaft, whereby the knitting yarn can be introduced to the rotating shaft and the rotor can be suitably rotated while preventing the knitting yarn from catching on the rotating shaft.

Furthermore, the rotor for a knitting element may be constituted comprising a pair of the rotor main bodies disposed opposite one another and spaced apart in an axial direction. Thus, a sinker for allowing the knitting yarn to escape can be disposed between the pair of rotor main bodies. Hence, an old loop (knitting yarn) which is engaged in the engagement recess can be suitably allowed to escape by the sinker disposed between the rotor main bodies.

In addition, the rotor for a knitting element may be constituted comprising a spring hook protruding outward from the circumferential face of the rotor main body, the spring hook being capable of sliding in a circumferential direction, wherein the spring hook is able to slide in the circumferential direction and modify a width of an opening of the engagement recess. Thus, knitting yarn can be knitted or floated by changing the width of the opening in the engagement recess.

A knitting method of the present invention is a knitting method using a knitting element employing rotational motion of a rotor, the rotor having a rotor main body, wherein a first engagement recess and a second engagement recess capable of engaging knitting yarn are formed in a circumferential face of the rotor main body, and a rotating shaft provided at a core of the rotor main body, the rotating shaft protruding outward, the knitting method comprising a step of passing the second engagement recess, with the first engagement recess engaging a first knitting yarn to form an old loop, through the old loop while the second engagement recess engages a second knitting yarn to form a new loop, due to the rotational motion of the rotor, and a step of making a stitch, after the step of passing through the old loop, by the old loop that escapes from the first engagement recess as a result of the first and second knitting yarns passing outside from both ends of the rotating shaft, respectively.

A knitting method of this type is able to form a new loop by causing the second engagement recess to engage the second knitting yarn by rotating the rotor in a state where the first engagement recess is engaging the first knitting yarn to form an old loop. The rotor rotates and the new loop passes through the old loop. After the new loop passes through the old loop, a stitch can be suitably made by the old loop escaping from the first engagement recess as a result of the first and second knitting yarns each passing outside from both ends of the rotating shaft.

DESCRIPTION OF THE PREFERRED EMBODIMENTS

Figure 1:
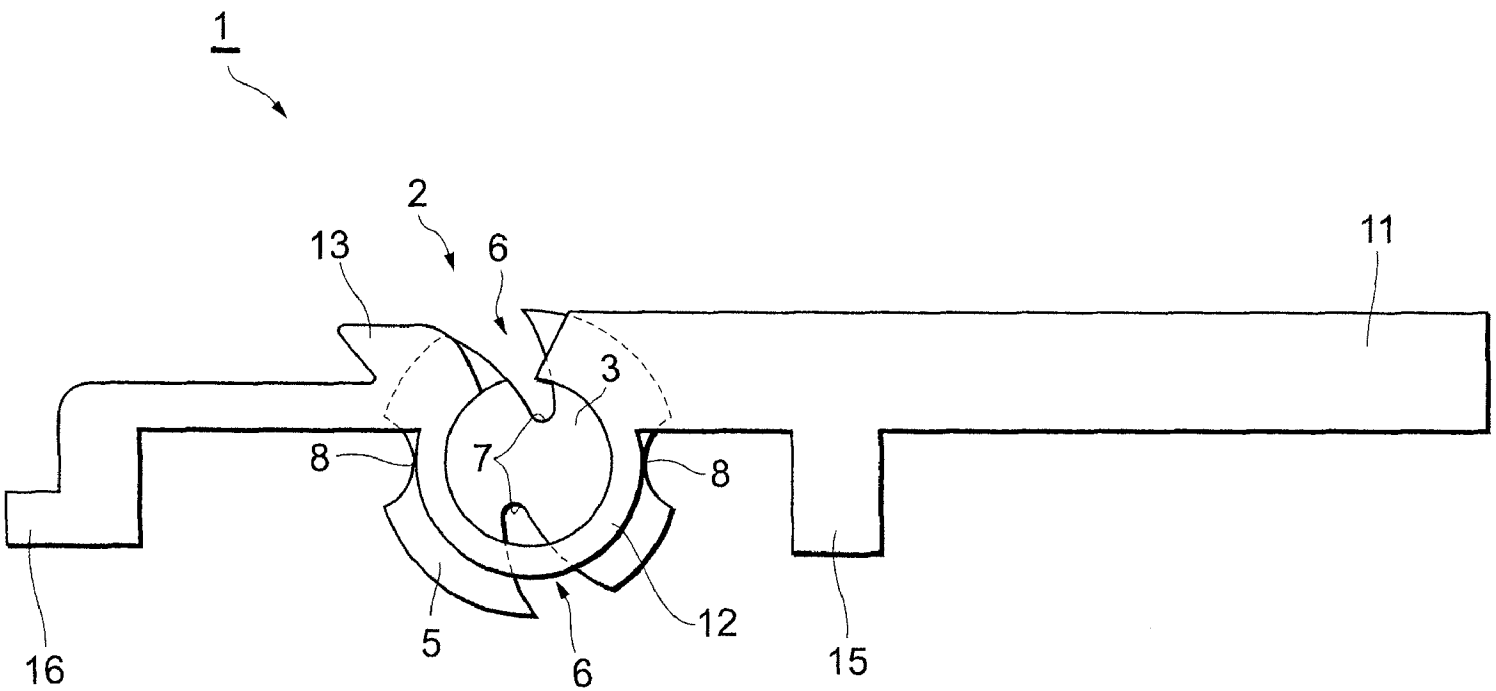
FIG. 1 is a front view of a knitting rotor according to a first embodiment of the present invention.

Preferred embodiments of the present invention will be described in detail hereinbelow with reference to the attached drawings. The same reference numerals are assigned to the same or equivalent elements in the respective drawings and repetitive description is avoided.

Figure 2:
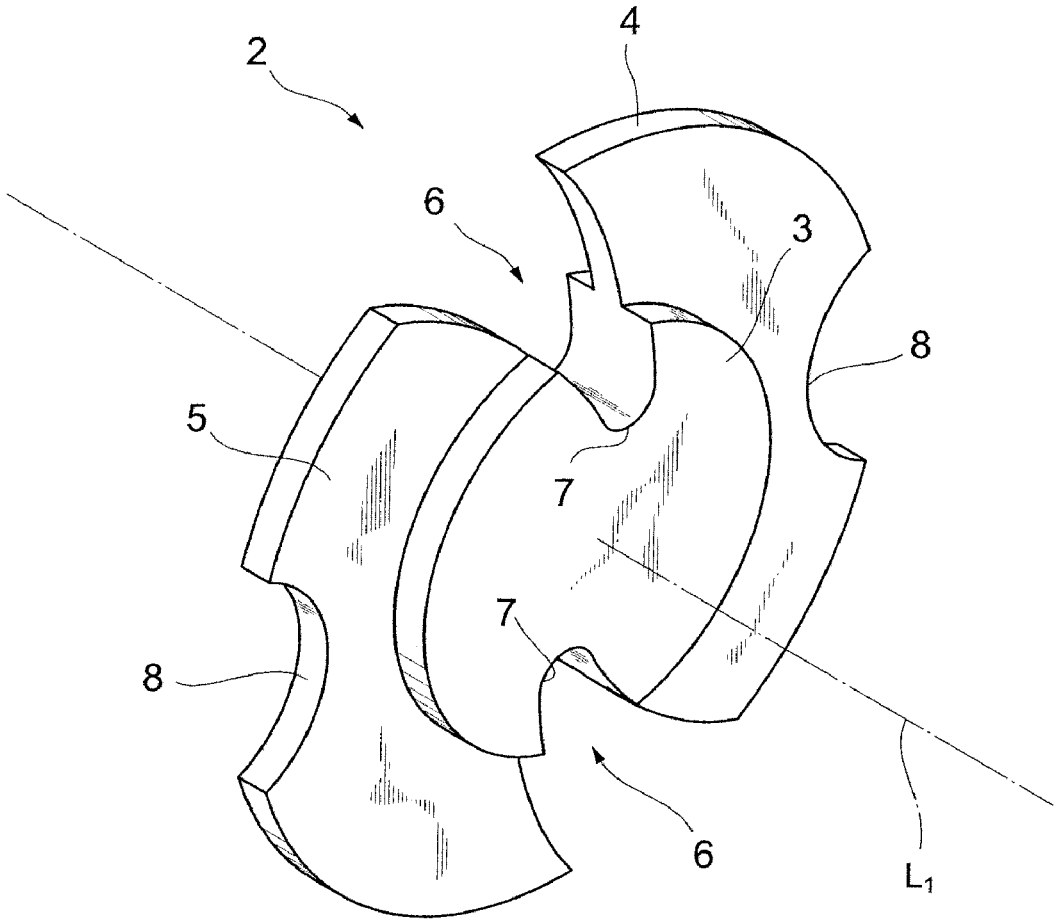
FIG. 2 is a perspective view of the rotor according to the first embodiment of the present invention.
Figure 3:
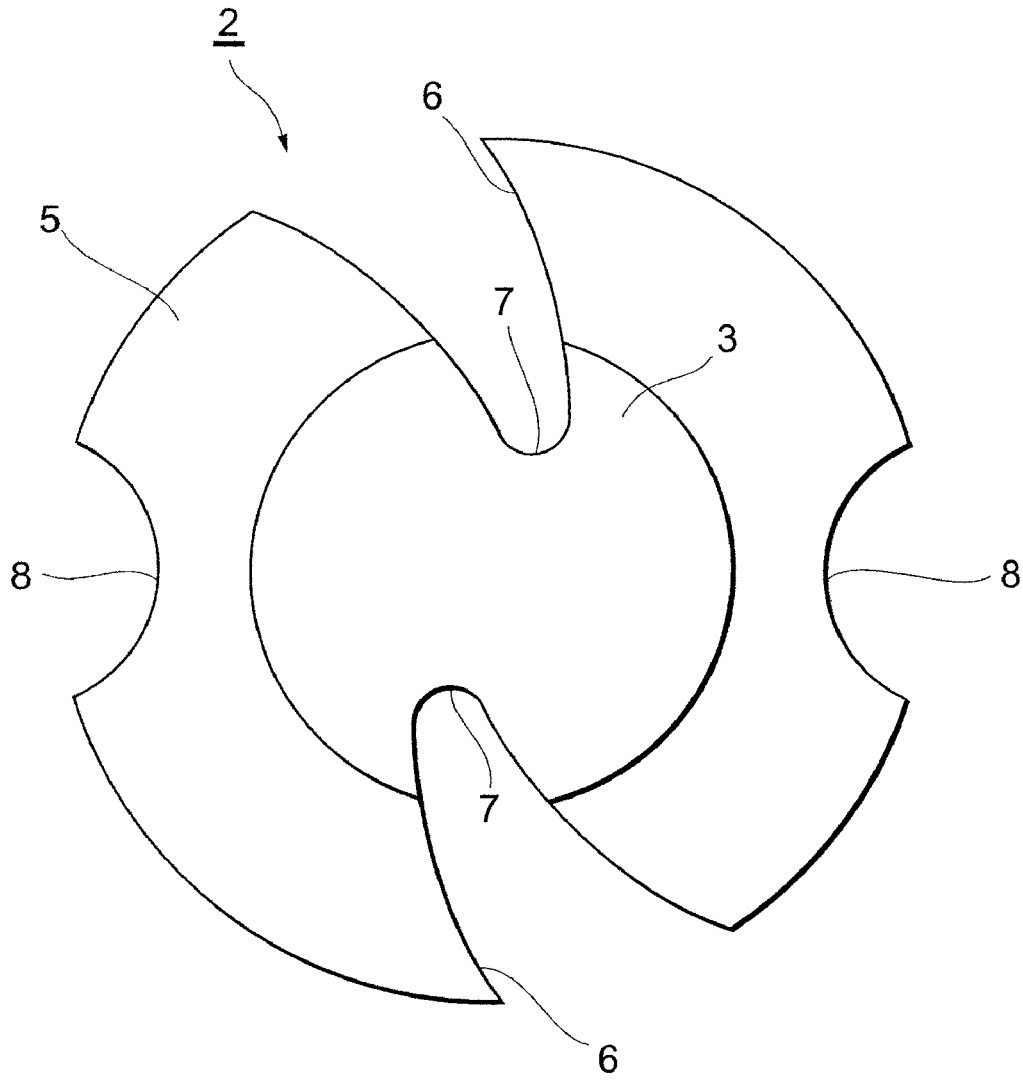
FIG. 3 is a front view of the rotor according to the first embodiment of the present invention.

FIG. 1 is a front view of a knitting rotor according to the first embodiment of the present invention. FIG. 2 is a perspective view of the rotor in FIG. 1. FIG. 3 is a front view of the rotor in FIG. 1. A knitting rotor 1 (knitting element) shown in FIG. 1 is a knitting element which is mounted on a circular knitting machine and utilized for knitting socks and the like, for example. The knitting rotor 1 comprises a rotor 2 which is capable of rotating about an axis $L_1$ (a first axis, see FIG. 2). The rotor 2 is formed with a disc shape, for example, as shown in FIGS. 2 and 3. The rotor 2 need not be formed with a disc shape and may have another shape.

The rotor 2 comprises a rotor shaft 3 (rotating shaft) which protrudes from a rotor main body (5) in both directions along the axis $L_1$. The amount of protrusion of the rotor shaft 3 in the direction of the axis $L_1$ is on the order of the sheet thickness of the rotor main body (5), for example. In the following description, parts which are formed jutting outward from the outer circumference of the rotor shaft 3 which is the rotor main body are referred to as the rotor blade 5.

A pair of hooks 6 (engagement recesses) are formed in the rotor blade 5 as recesses which are capable of engaging knitting yarn. A stitch loop is formed as a result of knitting yarn being engaged by these hooks 6 and the rotor 2 rotating about the axis $L_1$. The pair of hooks 6 are formed in opposite positions 180 degrees to each other. The hooks 6 are formed sinking from the circumferential face of the rotor 2 toward the core of the rotor 2. Furthermore, a large space which allows passage of the knitting yarn is formed between a bottom 7 of the hooks 6 and a holder bearing 12. The bottom 7 of the hooks 6 is formed extending inward from the outer circumferential face of the rotor shaft 3. The bottom 7 of the hooks 6 is formed over the entire width of the rotor shaft 3 in the direction of the axis $L_1$. When the rotor 2 is viewed from the direction of the axis $L_1$, the hooks 6 are formed with a beak shape.

In addition, a pair of rotor guides 8 (a guided portion and a guide recess) are formed in the rotor blade 5 as recesses which are utilized to rotationally drive the rotor 2. The pair of rotor guides 8 are formed in positions displaced by approximately 90 degrees on the circumference from the hooks 6. In other words, the pair of rotor guides 8 are formed in opposite positions 180 degrees to each other. The rotor guides 8 cooperate with guide portion rails, that is, a guide rail 22 and a spiral rail 23 (described subsequently) and regulate the rotational position of the rotor 2 about the axis $L_1$.

Figure 4:
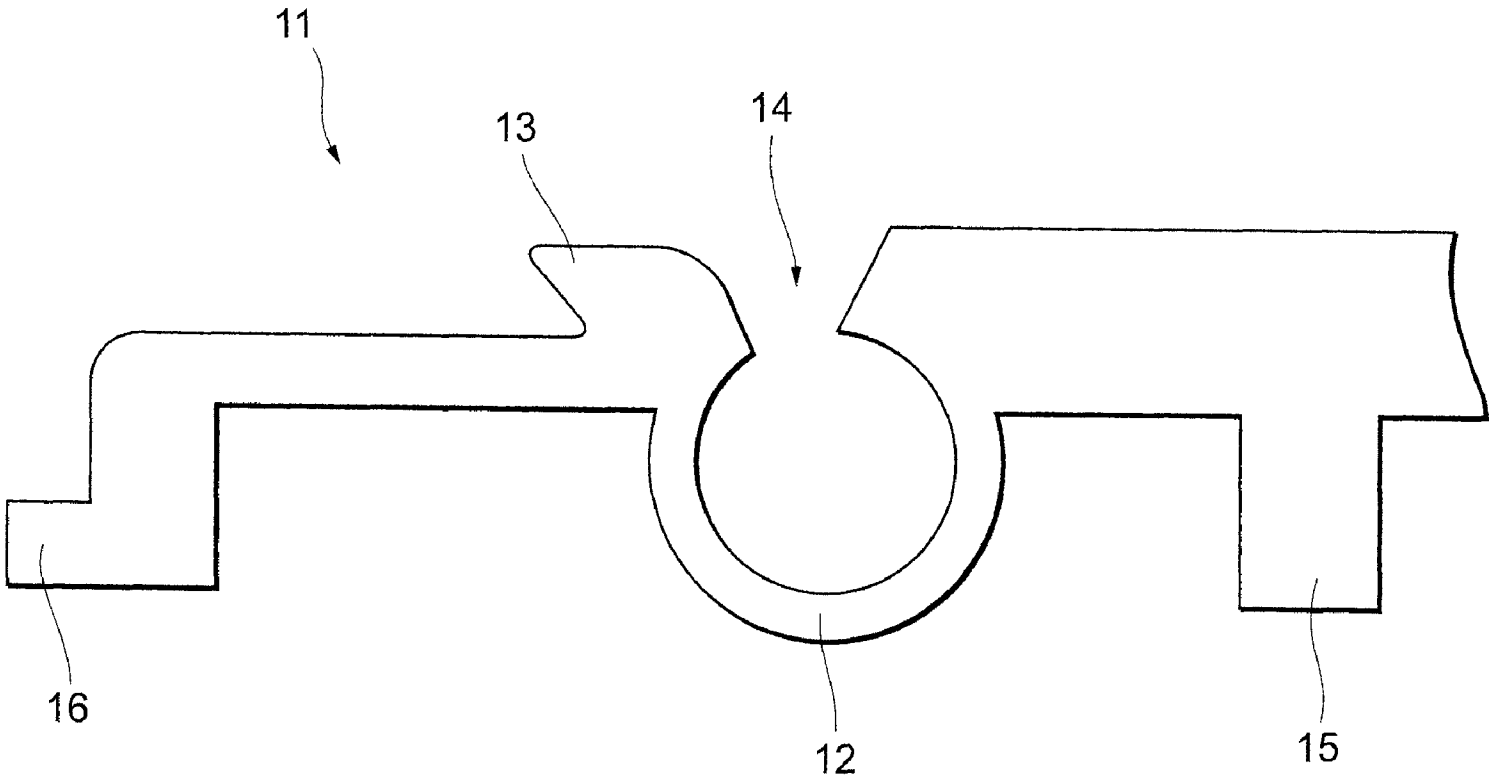
FIG. 4 is an essential part enlarged view of the holder in FIG. 1.

FIG. 4 is an essential part enlarged view of the holder in FIG. 1. As shown in FIGS. 1 and 4, the knitting rotor 1 comprises a holder 11 which supports the rotor 2 from both sides in the direction of the axis $L_1$ (See FIG. 2). The holder 11 comprises a holder main body which extends in a longitudinal direction (a direction orthogonal to the axis $L_1$, for example).

The holder 11 comprises a holder bearing 12 which rotatably supports the rotor 2. The holder bearing 12 is formed in an arc shape along the outer circumference of the rotor shaft 3. An abutment face which butts against the outer circumferential face of the rotor shaft 3 is formed on the inner circumferential side of the holder bearing 12. That is, the rotor shaft 3 slides and the rotor 2 rotates about the axis.

A holder opening 14 (cutout) is formed in the holder bearing 12. The holder opening 14 allows the knitting yarn to be introduced to the hooks 6 and enables knitting yarn engaged by the hooks 6 to escape. The knitting yarn passes through the holder opening 14 and is caught on the hooks 6. The size of the holder opening 14 decreases toward the rotating shaft and the knitting yarn can thus be reliably guided to the hooks 6 of the rotor 2.

The outer circumferential side of the holder bearing 12 forms an arc shape. In a state where the rotor shaft 3 is held on the holder bearing 12, the outer circumferential side of the rotor blade 5 juts outward from the outer circumference of the holder bearing 12. Furthermore, the rotor guides 8 are exposed to the outside from the outer circumference of the holder bearing 12, whereby the rotor guides 8 are able to butt against the rails (the guide rail 22 and the spiral rail 23).

One end of the holder 11 in the longitudinal direction is a holder tip 16. The holder tip 16 is disposed at the center of the cylinder of the circular knitting machine.

A holder nail 13 is formed on the holder 11. The holder nail 13 is formed extending from the holder bearing 12 toward the holder tip 16. The holder nail 13 engages the knitting yarn on the side of the holder tip 16 so that the knitting yarn does not move toward the holder bearing 12. Movement downstream by a stitch which escapes from the hooks 6 can thus be constrained by the holder nail 13. A holder butt 15 which is a protrusion for regulating the position of the holder 11 in a fore/aft direction is formed on the holder 11.

Further, by including the rotor 2 in the holder 11, an independent knitting element is made in the form of the knitting rotor 1.

Figure 5:
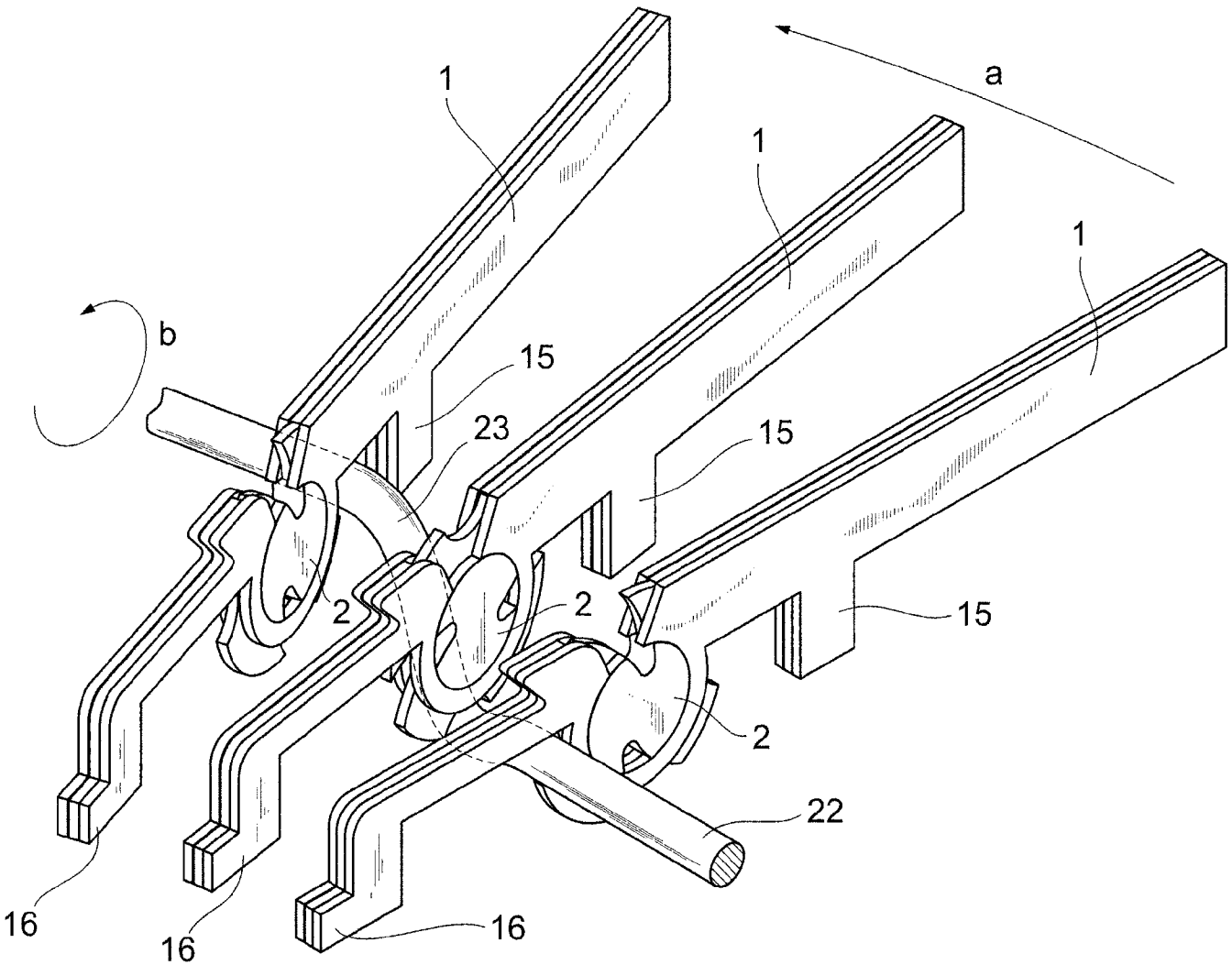
FIG. 5 is a schematic perspective view of the positional relationship between the knitting rotor and a spiral rail according to the first embodiment of the present invention.

FIG. 5 is a schematic perspective view of the positional relationship between the knitting rotor and a spiral rail according to the first embodiment of the present invention.

Figure 6:
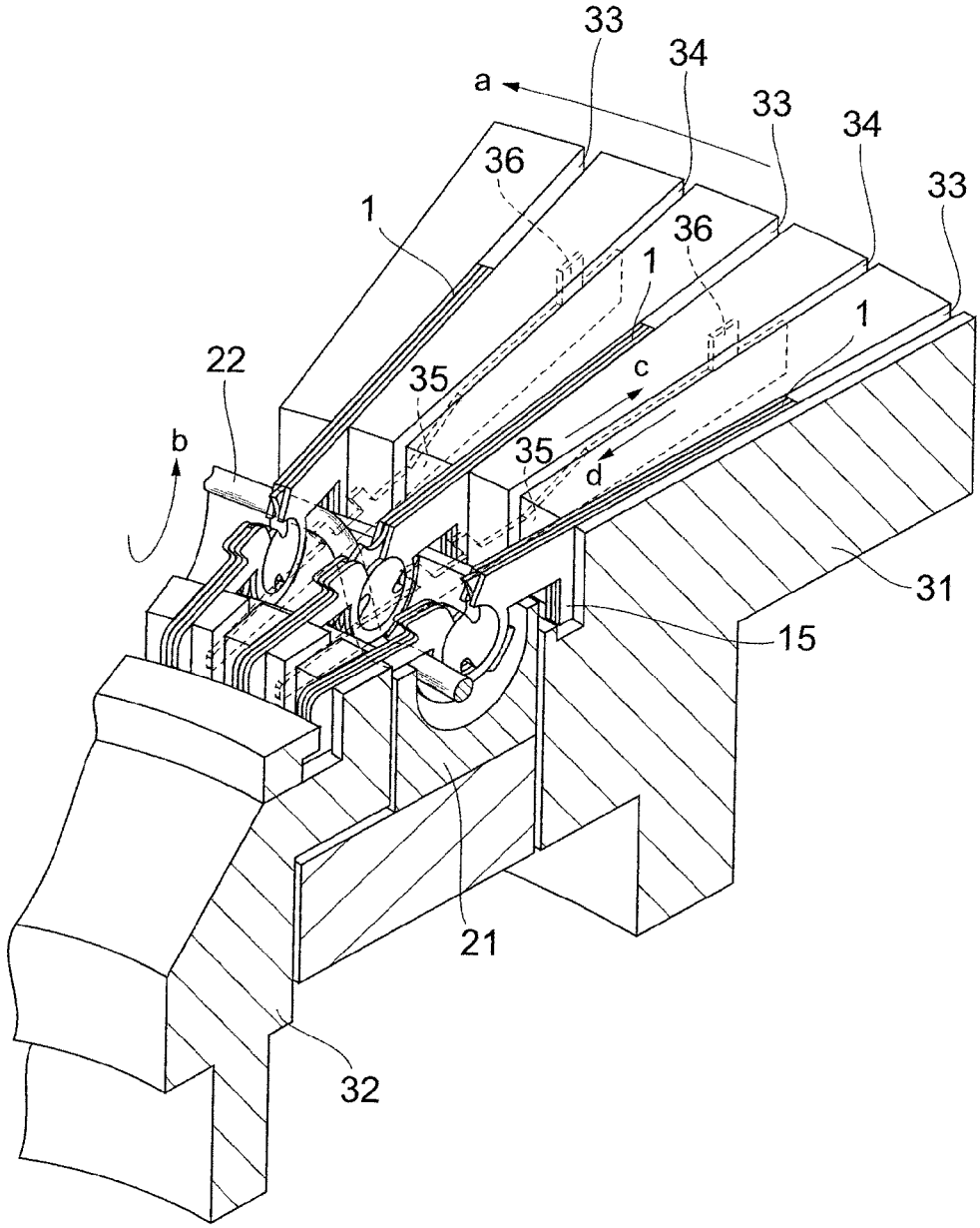
FIG. 6 is a cross-sectional perspective view of a turntable to which the knitting rotor according to the first embodiment of the present invention is attached.

FIG. 6 is a cross-sectional perspective view of a turntable in which the knitting rotor according to the first embodiment of the present invention is incorporated. The knitting rotor 1 is used inserted in a turntable of a circular knitting machine, for example.

In this embodiment, a spiral rail system (described subsequently) has been adopted as the method of driving (rotating) the rotor 2. In cases where the spiral rail system is applied to a knitting machine, a plurality of knitting rotors 1 are used arranged in the operating direction of the knitting rotors 1 (direction a) as shown in FIGS. 5 and 6. The spiral rail system is a method of causing the rotor 2 to rotate by regulating the rotational position of rotor 2 in direction b (shown) by causing the knitting rotors 1 to slide in direction a (shown) while the rotor guides 8 are meshed with the helically formed spiral rail 23.

The rotor guide 8 gyrates through an orbit in direction a while engaged with at least one of the guide rail 22 and spiral rail 23. When the knitting rotors 1 move in direction a (shown), the rotor 2 rotates in direction b (shown) as a result of the rotor guides 8 sliding on the helical spiral rail 23. The rotation of the rotor 2 in direction b (shown) is one example of rotation about a first axis and the rotation of the knitting rotors 1 in direction a (shown) is one example of rotation about a second axis. The first axis is a circumferential tangent which is centered on the second axis.

As shown in FIG. 6, the turntable (holder) of the circular knitting machine comprises an outer sinker bed A31 disposed on the outer circumferential side and an inner sinker bed A32 disposed on the inner circumferential side. The outer sinker bed A31 and inner sinker bed A32 are formed in a ring shape in a planar view and are disposed radially separate from one another. A plurality of holder slots 33 (stitch holding portion) are formed in the outer sinker bed A31 and inner sinker bed A32. The holder slots 33 are formed radially. The knitting rotors 1 are inserted in the holder slots 33 so as to be detachably fixed. Removal of the knitting rotors 1 from the turntable is thus straightforward and maintenance is simplified.

Furthermore, a groove in which the holder butt 15 of the holder 11 is inserted is formed on the inner circumferential side of the outer sinker bed A31. A groove in which the holder tip 16 is inserted is formed in the inner sinker bed A32. The holder butt 15 and holder tip 16 which correspond to these grooves are inserted therein such that radial and vertical movement of the knitting rotors 1 is constrained. The knitting rotors 1 can thus be suitably fixed to the turntable.

Sinker slots 34 are radially formed in the outer sinker bed A31 between adjacent holder slots 33. In other words, the holder slots 33 and the sinker slots 34 are formed alternately in the circumferential direction (direction a). That is, the knitting rotors 1 and sinkers 35 are disposed alternately in a circumferential direction. The sinkers 35 are inserted in the sinker slots 34 and slidable in the radial direction of the turntable.

When the outer sinker bed A31 and inner sinker bed A32 gyrate in direction a (shown), the knitting rotors 1 and sinkers 35 also gyrate as a unit. When the rotor 2 moves along a rail base 21, the rotational position of the rotor 2 is guided by the guide rail 22 and spiral rail 23 and the rotor 2 rotates in direction b (shown) (about axis $L_1$).

Thereupon, the sinkers 35 slide in directions c and d (shown) under the action of a cam (not illustrated) toward a sinker bed 36 and allow an old loop 201 to escape. The old loop 201 escapes outward from the holder opening 14. The position of the knitting rotor 1 in the radial position of the turntable is regulated by the holder butt 15 in the holder slot 33.

Figure 7:
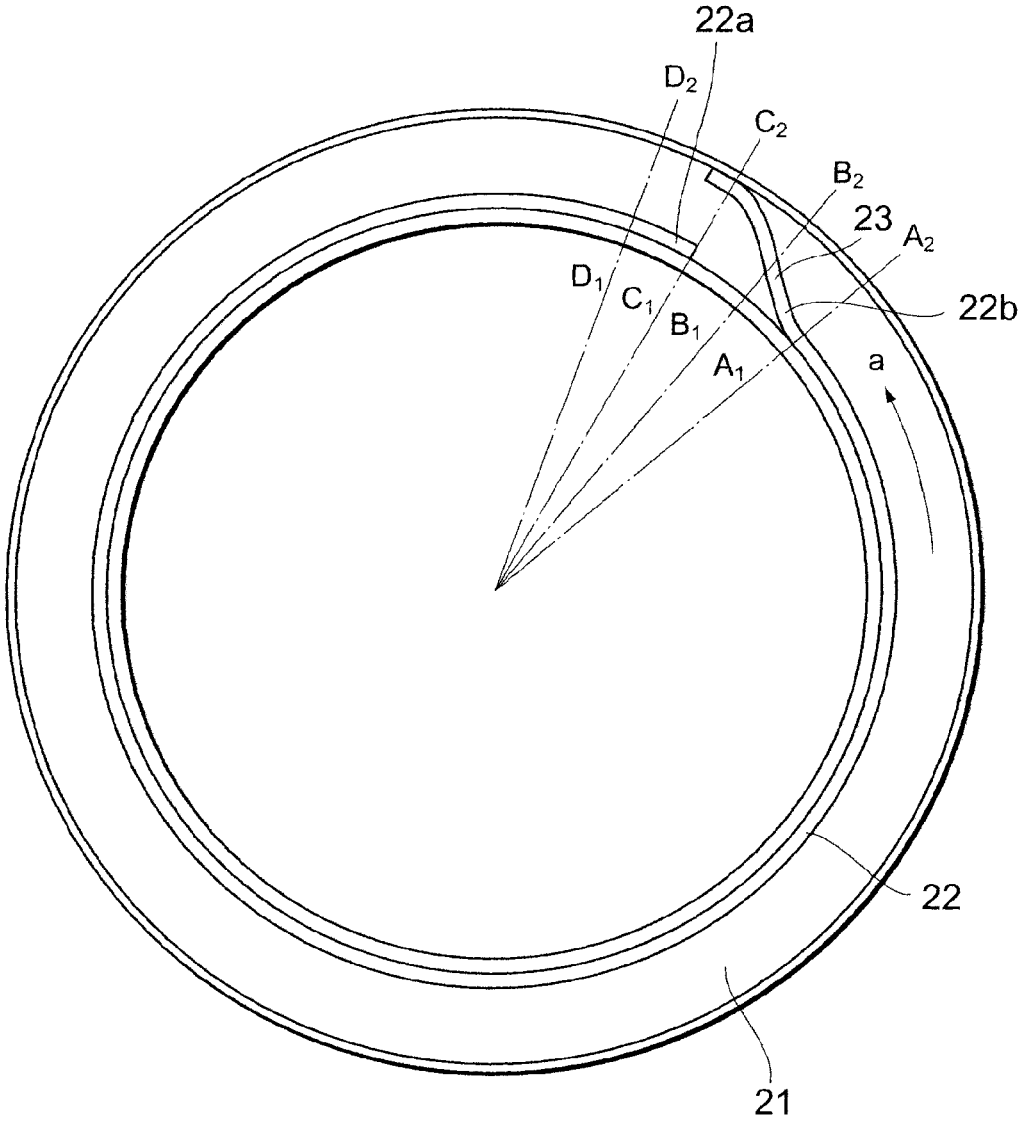
FIG. 7 is a planar view of a rail base according to the first embodiment of the present invention.
Figure 8:
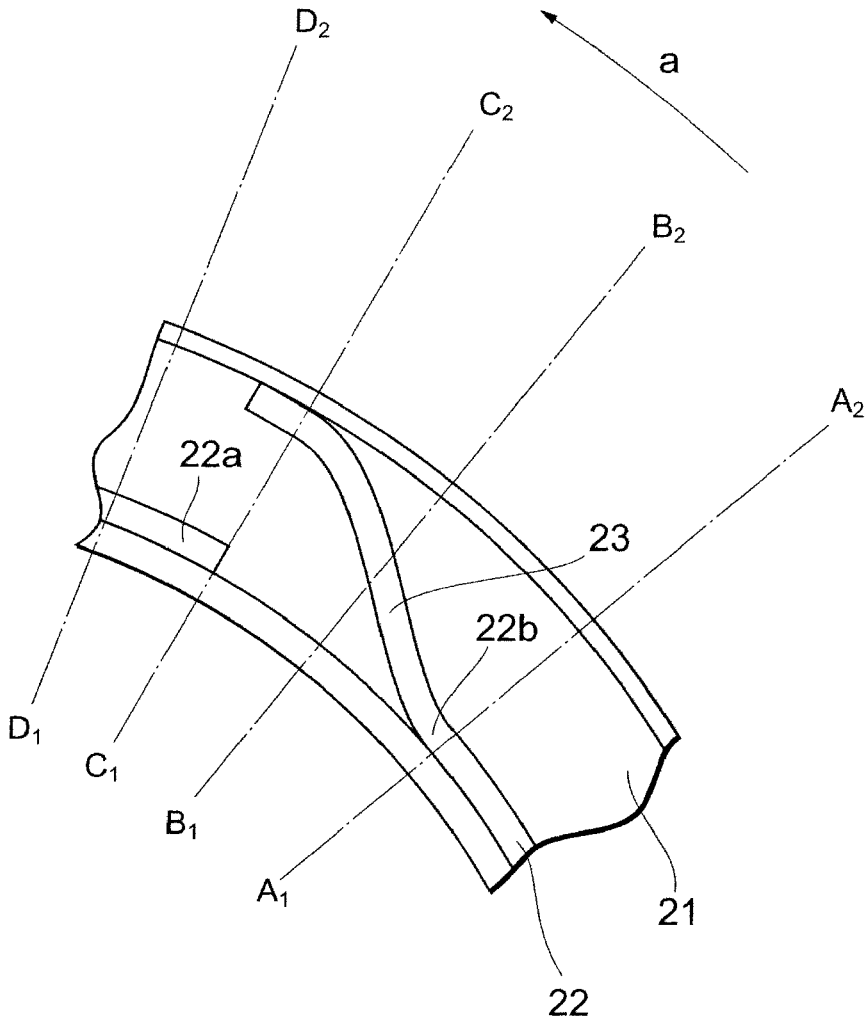
FIG. 8 is an enlarged view of the spiral rail.
Figure 9:
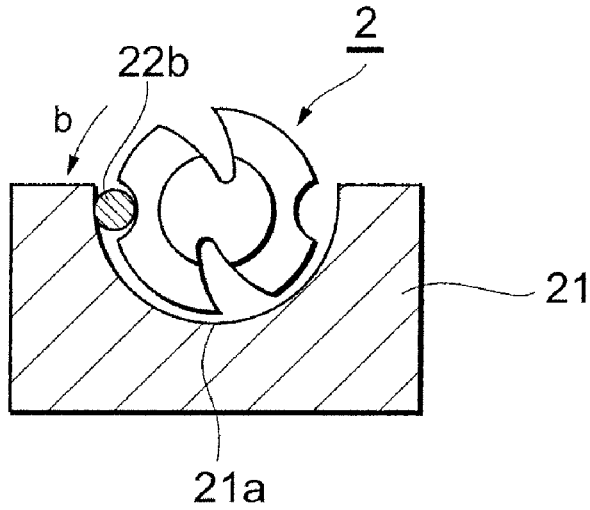
FIG. 9 provides cross-sectional views of the rail base and the spiral rail.
Figure 9:
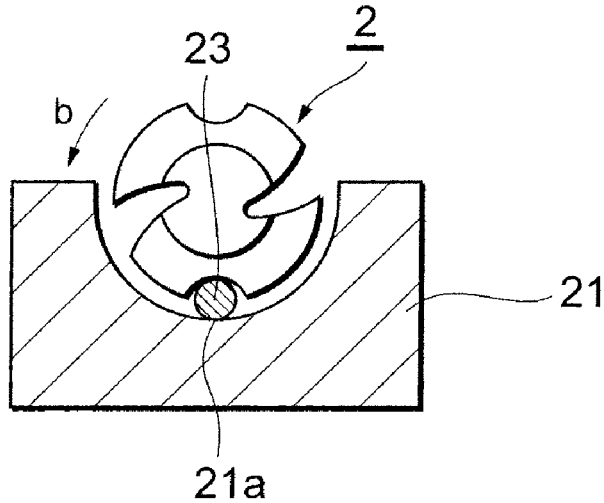
Figure 9:
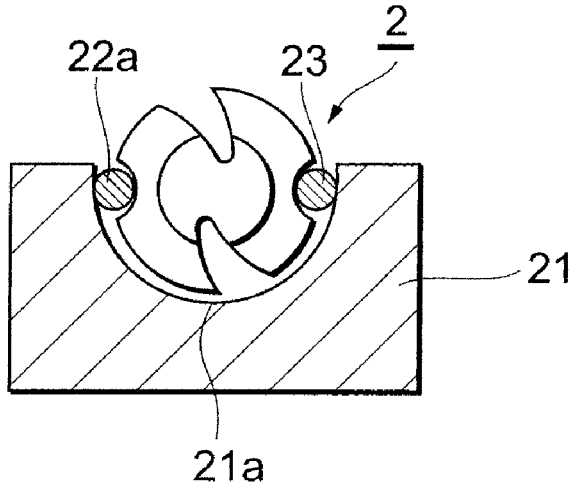

FIG. 7 is a planar view of the rail base according to the first embodiment of the present invention. FIG. 8 is an enlarged view of the spiral rail. FIG. 9 is a cross-sectional view of the rail base and the spiral rail. (A) of FIG. 9 is a cross-sectional view along the lines $A_1$-$A_2$ and $D_1$-$D_2$ in FIG. 8. (B) of FIG. 9 is a cross-sectional view along the line $B_1$-$B_2$ in FIG. 8. (C) of FIG. 9 is a cross-sectional view along the line $C_1$-$C_2$ in FIG. 8.

Figure 10:
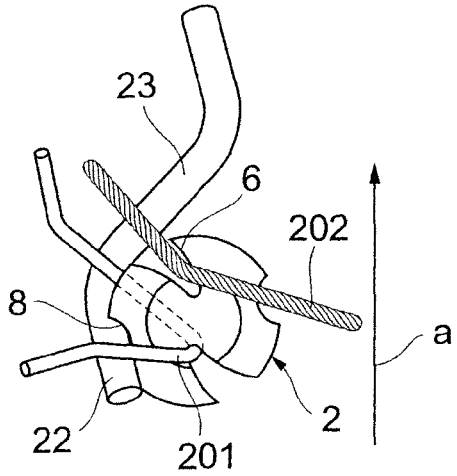
FIG. 10 is a front view of the relationship between the spiral rail, the rotational position of the rotor, and knitting yarns.
Figure 10:
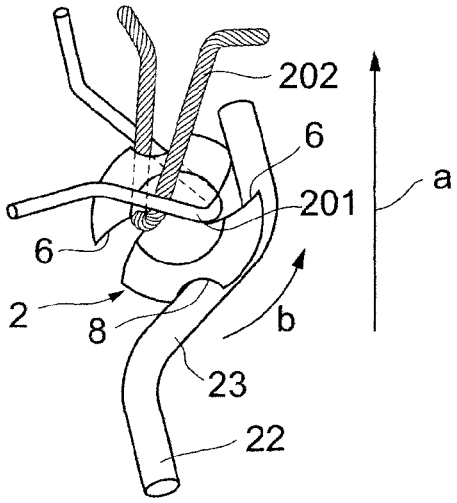
Figure 10:
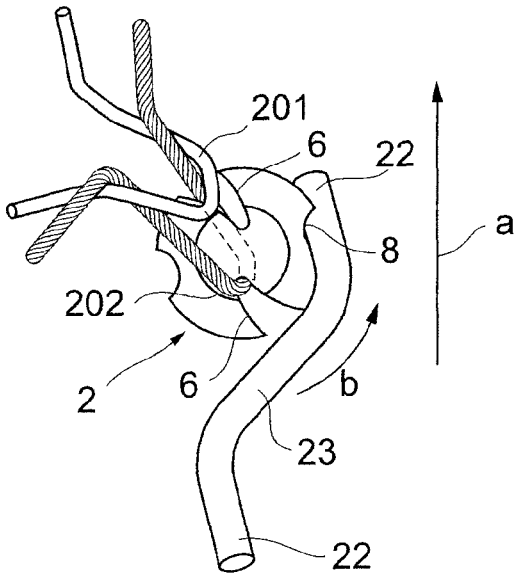

FIG. 10 is a front view of the relationship between the spiral rail, the rotational position of the rotor, and knitting yarns. (A) of FIG. 10 shows the state of the rotor 2 in a position on line $A_1$-$A_2$ in FIG. 8. (B) of FIG. 10 shows the state of the rotor 2 in a position on line $B_1$-$B_2$ in FIG. 8. (C) of FIG. 10 shows the state of the rotor 2 in a position on line $C_1$-$C_2$ in FIG. 8.

The circular knitting machine to which the knitting rotor 1 of this embodiment is applied comprises the rail base 21 which forms the orbit of the rotor 2 as shown in FIG. 7. A recess is formed in the rail base 21 as shown in FIG. 9. The cross-sectional shape of the recess is a semicircular shape in order to match the outer shape of the rotor 2. The rotor 2 moves along the orbit with its lower half housed within the recess.

As shown in FIGS. 7 and 9, a rail is provided in the recess of the rail base 21. The rail comprises the guide rail 22 and the spiral rail 23. The rotor 2 gyrates to the left (direction a) along the rail base 21 as shown in FIG. 7. The guide rail 22 and spiral rail 23 regulate the rotational position about the axis $L_1$ of the rotor 2. The rotor guides 8 of the rotor 2 regulate the rotational position of the rotor 2 about the axis $L_1$ by meshing with the guide rail 22 or the spiral rail 23.

The guide rail 22 is formed to maintain the rotational position of the rotor 2 about the axis $L_1$. The guide rail 22 is formed in the same position (same phase) in the cross section of the rail base 21 (cross-section crossing illustrated direction a).

The spiral rail 23 is helically formed and formed to rotationally drive the rotor 2 about the axis $L_1$. In other words, the spiral rail 23 is formed to regulate the rotational position of the rotor 2 in direction b in response to the rotational position of the knitting rotors 1 in direction a. As shown in FIG. 7, the guide rail 22 is formed continuously to follow the semicircular shape of the recess of the rail base 21 from the upper left of FIG. 7 (inner circumferential side) toward the lower middle and then the upper right of FIG. 7 in a position in direction a, for example. As shown in FIGS. 7 and 8, the spiral rail 23 is formed continuously from an end 22*b* of the guide rail 22 and, in a planar view, is formed toward the opposite outer circumferential side of the leading end 22*a* of the guide rail 22. The rotor 2 is rotationally driven about axis $L_1$ as a result of the rotor guides 8 of the rotor 2 meshing with the spiral rail 23.

(A) of FIG. 10 shows the start position of the rotation in direction b of the rotor 2 in position $A_1$-$A_2$. Here, the rotor guides 8 are meshed with the guide rail 22. While the rotor 2 moves from this state in the direction of arrow a and reaches position $B_1$-$B_2$, the rotor 2 rotates through 90 degrees in direction b (shown) while a knitting yarn 202 is received by hook 6 as shown in (B) of FIG. 10. Due to this rotation, the old loop 201 is introduced as far as the hook bottom 7 and passes through the outside of both sides of the rotor shaft 3. In addition, while the rotor 2 moves from position $B_1$-$B_2$ in the direction of the arrow a and reaches position $C_1$-$C_2$ shown in (C) of FIG. 10, the rotor 2 rotates through 90 degrees in direction b (shown) and the old loop 201 escapes from the holder opening 14. That is, the rotor 2 rotates through 180 degrees in direction b (shown) while moving from position $A_1$-$A_2$ to reach position $C_1$-$C_2$.

Further, the rotor 2 continues to go around the rail groove 21*a* to re-reach $A_1$-$A_2$, and repeats the same rotation in direction b. Meanwhile, a loop is stitched as a result of the action of the knitting yarn mentioned hereinabove. In FIG. 7, the spiral rail 23 is formed in only one section of one revolution of the rail base 21, but the spiral rail 23 may also be installed in a plurality of sections of one revolution. As a result, the rotor 2 can be made to rotate through 180 degrees a plurality of times for a single revolution of the knitting rotors 1.

Figure 11:
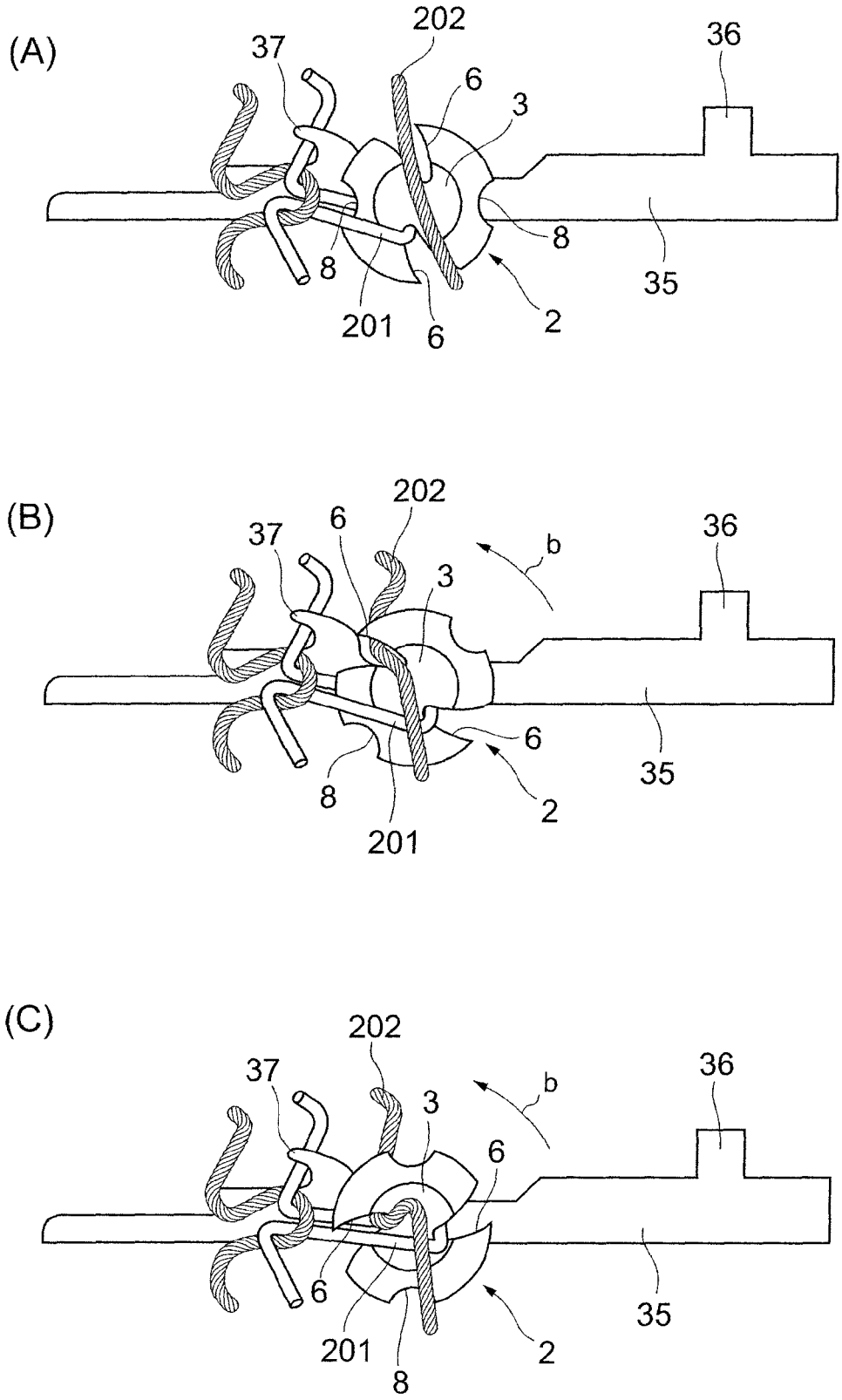
FIG. 11 shows a knitting cycle of the rotor according to the first embodiment of the present invention.
Figure 12:
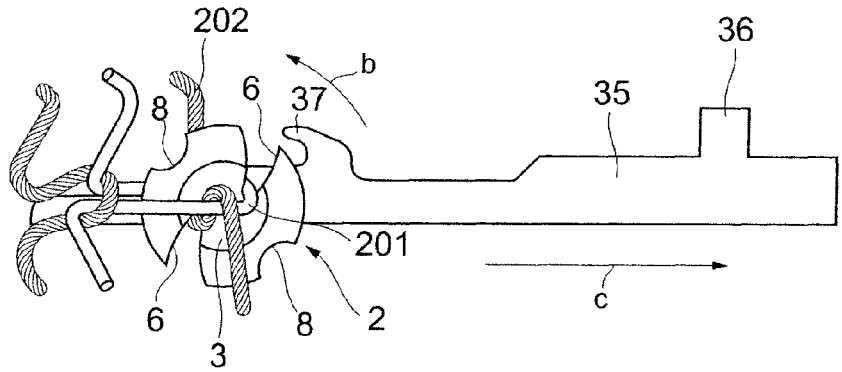
FIG. 12 shows the knitting cycle of the rotor according to the first embodiment of the present invention.
Figure 12:
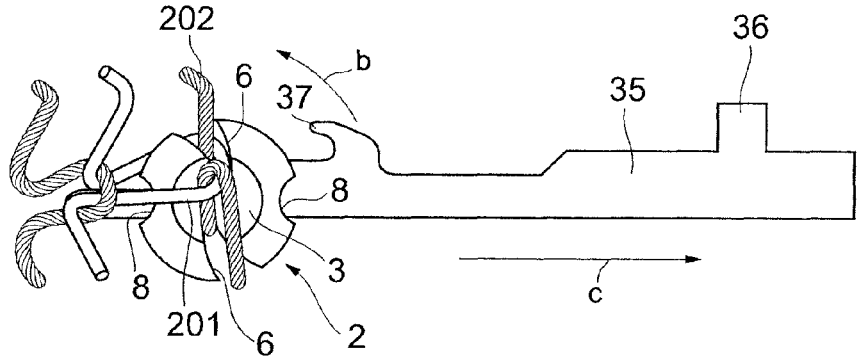
Figure 12:
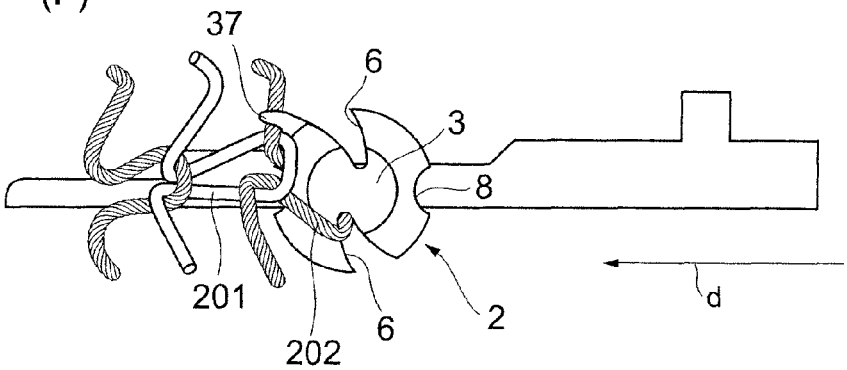

A knitting method which employs the rotational motion of the rotor 2 (knitting fabrication method) will be described next. FIGS. 11 and 12 show the knitting cycle by the rotor according to the first embodiment of the present invention. The rotor 2 operates by rotating in the direction of arrow b (counterclockwise in FIGS. 11 and 12).

The position of rotor 2 shown in (A) of FIG. 11 will now be described as a reference rotational position (0 degree). As shown in (A) of FIG. 11, the knitting yarn 202 is supplied to the rotor 2 when the rotor 2 is in a 0 degree position (origin). Here, the old loop 201 is engaged in the lower hook 6 (hook bottom 7).

The rotor 2 rotates through 45 degrees from the 0 degree position shown in (A) of FIG. 11 and assumes the state shown in (B) of FIG. 11. The rotor 2 starts to receive the knitting yarn 202 by means of the upper hook 6 upon being rotationally driven from the 0 degree position to the 45 degree position. That is, the knitting yarn 202 starts to be caught on the upper hook 6.

The rotor 2 rotates through 45 degrees from the 45 degree position shown in (B) of FIG. 11 and assumes the state shown in (C) of FIG. 11. When the rotor 2 rotates from the 45 degree position to a 90 degree position, the knitting yarn starts to pass through the old loop 201 while forming a new loop.

The rotor 2 rotates through 45 degrees from the 90 degree position shown in (C) of FIG. 11 and assumes the state shown in (D) of FIG. 12. When the rotor 2 rotates from the 90 degree position to a 135 degree position, the new loop 202 passes through the old loop 201. Here, the sinker 35 retreats in the direction of an arrow c (to the right of (D) of FIG. 12 toward the outside of the turntable in a radial direction).

The rotor 2 rotates through 45 degrees from the 135 degree position shown in (D) of FIG. 12 and assumes the state shown in (E) of FIG. 12. The passage of the new loop 202 through the old loop 201 ends when the rotor 2 rotates from the 135 degree position to the 180 degree position.

Further, as shown in (F) of FIG. 12, the sinker 35 advances in the direction of an arrow d (to the left of (F) of FIG. 12 toward the outside of the turntable in a radial direction) while the rotor 2 is in the 180 degree position and the old loop 201 escapes from the hook 6. Furthermore, while the rotor 2 is rotating, the stitch (loop) passes outside from both ends of the rotating shaft 3.

This knitting rotor 1 of the first embodiment has the rotor shaft 3 provided on both sides of the rotor main body (5) in the direction of the axis $L_1$ and is therefore easily rotationally driven. The rotor shaft 3 is also formed in a button shape with limited protrusion. It is therefore easy for a loop to pass through both sides of the rotor shaft 3.

Furthermore, the hook 6 is formed deeply cut toward the middle (core) of the rotor main body (5) and knitting yarn is therefore reliably received within the hook 6. The hook bottom 7 is cut toward the inside of the rotor shaft 3, thus preventing knitting yarn from becoming entwined on the rotor shaft 3 due to the rotation of the rotor 2.

Each rotor 2 is rotatably supported by the holder 11 and constituted as an independent knitting tool and is therefore optimally suited to a knitting machine in which a turntable (cylinder) rotates such as a circular knitting machine. The position of the holder 11 is fixed and the knitting holders 1 of this embodiment may be applied to a flat-knitting machine or a warp-knitting machine which moves a rotating mechanism (rail base).

Furthermore, the knitting rotors 1 are constituted as independent knitting elements. The knitting rotors (holders) 1 are therefore easily exchanged and maintenance can be performed efficiently. In cases where one knitting rotor 1 is damaged, only this knitting rotor need be exchanged.

Since the rotor guides 8 are drive-rotated by being made to mesh with the spiral rail 23, the rotational position of the rotor 2 can be accurately regulated and constrained driving is straightforward.

Furthermore, because the constitution comprises the rotor shaft 3, the rotor 2 can be rotationally driven without the prior restrictions on the shape of the rotor circumference. Thus, a rotation system such as a rack and pinion system can be adopted.

Furthermore, by changing the shape of the hook 6 and the direction of rotation of the rotor 2, a plain stitch, a rib stitch, a purl stitch, and a links-links stitch can be made.

By changing the size (diameter) of the rotor 2, the rotor 2 can be applied to knitting machines ranging from a high gauge to a low gauge.

In addition, because stitches can be formed through the rotation of the rotor 2, there is no need to allow space for a mechanism for generating the reciprocating motion of a knitting needle as is required for a conventional latch needle. Miniaturization of the knitting machine is therefore possible.

Moreover, conventional methods which employ a latch needle are confronted by problems such as an excessive force acting on the knitting yarn due to a stitch (yarn feed) and loop release being performed using reciprocating motion. This embodiment allows yarn to be fed and to escape through the rotational motion of the rotor 2 and the tensile force acting on the knitting yarns 201 and 202 to be reduced. Thus, even when a weak yarn of the kind that cannot be stitched using a conventional latch needle is supplied, knitting can be suitably performed by using the knitting rotors 1 of this embodiment.

Furthermore, in the prior art of FIG. 8 of U.S. Pat. No. 3,971,232, because knitting yarn is pulled by using a single puller (which makes the same movement as a sinker) for a plurality of rotors, there is the problem that the knitting yarn cannot be pulled according to the rotational position of each rotor. However, with the knitting machine comprising the knitting rotors 1 of this embodiment, because one sinker 35 is provided for one rotor 2, the operation of the sinkers 35 can be controlled independently in accordance with the knitting cycle of each rotor 2.

The knitting rotor and rotor driving method (driving device) according to the second embodiment of the present invention will be described next with reference to the drawings. The knitting rotors of the second embodiment differ from the knitting rotors 1 of the first embodiment in that the rotor driving method is different and the rotor shape is different. Description which is the same as that of the first embodiment will be omitted.

Figure 13:
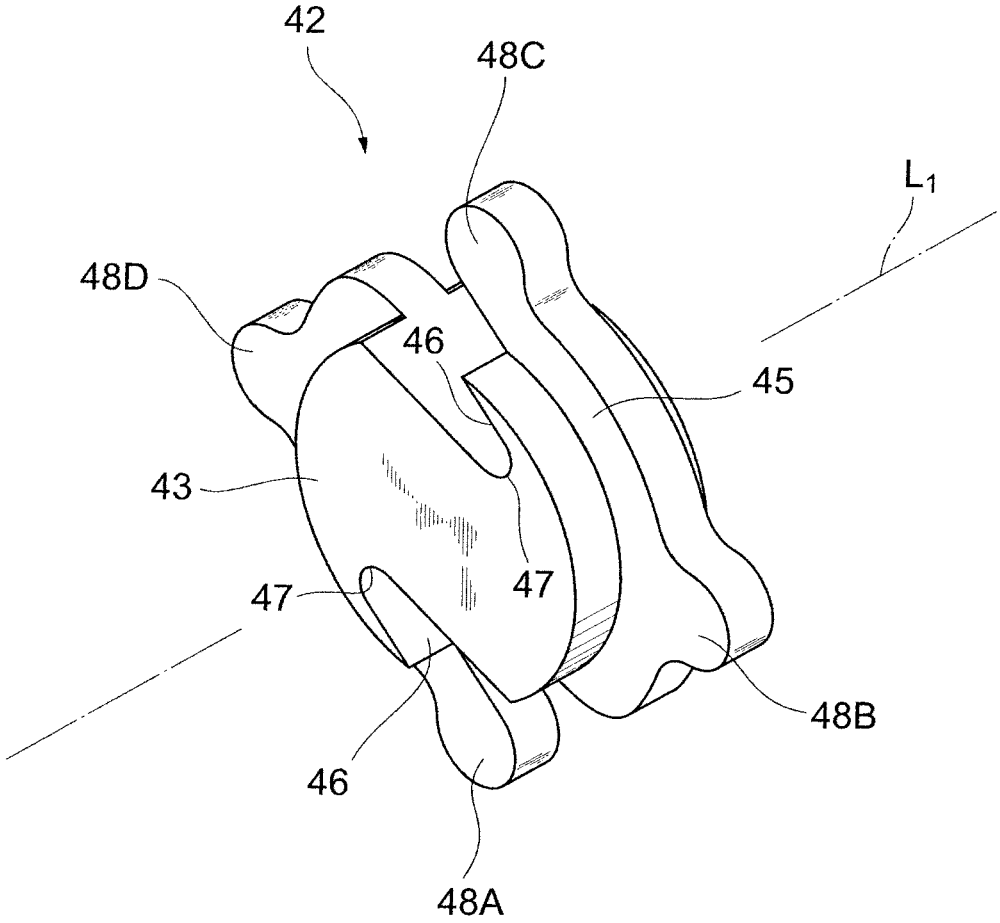
FIG. 13 is a perspective view of the rotor according to a second embodiment of the present invention.
Figure 14:
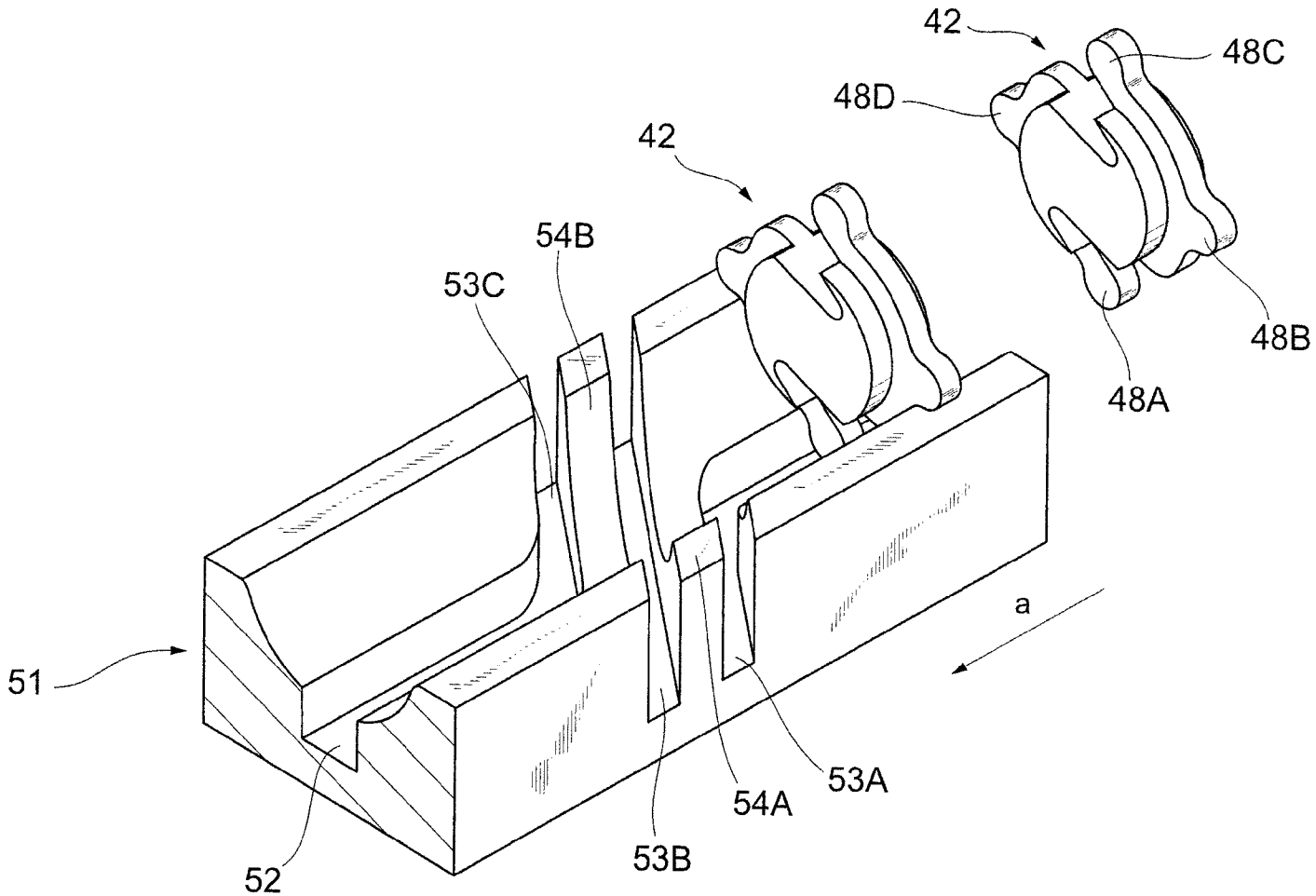
FIG. 14 is a perspective view of the rotor and a rack base according to the second embodiment of the present invention.
Figure 15:
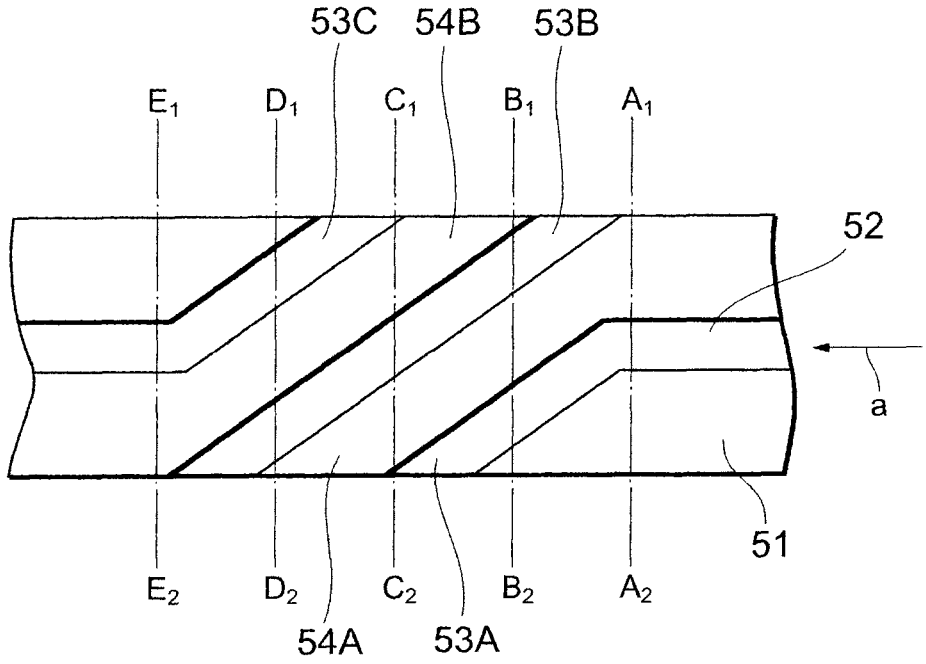
FIG. 15 is a planar view of the rack base in FIG. 14.

FIG. 13 is a perspective view of a rotor according to the second embodiment of the present invention. FIG. 14 is a perspective view of a rotor and rack base according to the second embodiment of the present invention. FIG. 15 is a planar view of the rack base in FIG. 14.

A rotor 42 comprises a rotor shaft 43 which protrudes from a rotor main body (45) in both directions along the axis $L_1$. The amount of protrusion of the rotor shaft 43 in the direction of the axis $L_1$ is on the order of the sheet thickness of the rotor main body (45), for example. In the following description, the part which is formed jutting outward from the outer circumference of the rotor shaft 43 which is the rotor main body is referred to as the rotor blade 45.

A pair of hooks (engagement recesses) 46 are formed in the rotor blade 45 as recesses which are capable of engaging knitting yarn. A stitch loop is formed as a result of knitting yarn being engaged by these hooks 46 and the rotor 42 rotating about the axis $L_1$. The pair of hooks 46 are formed in opposite positions 180 degrees to each other. The hooks 46 are formed so as to sink from the circumferential face of the rotor 42 toward the core of the rotor 42. A bottom 47 of the hooks 46 is formed extending inward from the outer circumferential face of the rotor shaft 43. The bottom 47 of the hooks 46 is formed over the entire width of the rotor shaft 43 in the direction of the axis $L_1$.

The rotor driving method (driving device) according to the second embodiment adopts a rack and pinion system. The rotor blade 45 comprises a plurality of rotor teeth 48A to 48D (guided portion, guide protrusion) which are protrusions for rotationally driving the rotor 42. The rotor teeth 48A to 48D are disposed at equal intervals on the circumference of the rotor 42. The rotor teeth 48A to 48D are each disposed in different positions at a rotational angle of 90 degrees. The plurality of rotor teeth 48A to 48D cooperate with a rack base 51 (described subsequently) and regulate the rotational position of the rotor 42 about the axis $L_1$.

The rack base 51 shown in FIG. 14 is disposed in the direction of movement of the rotor 42. A recess housing part of the rotor 42 is formed in the rack base 51. The cross-section of the recess of the rack base 51 forms a semicircle so as to correspond to the rotor 42. Grooves as guide portion, that is, a guide groove 52 and rack grooves 53A to 53C are formed in this recess. The guide groove 52 extends in the longitudinal direction of the rack base 51. The rotor teeth 48A to 48D of the rotor 42 are regulated by the guide groove 52 to assume the same rotational position (same phase).

In addition, rack teeth 54A and 54B and the rack grooves 53A to 53C which rotationally drive the rotor 42 by meshing with the rotor teeth 48A to 48D are formed in the recess of the rack base 51. The rack teeth 54A and 54B and the rack grooves 53A to 53C are formed intersecting the direction in which the rack base 51 extends. The rotor 42 slides along the rack base 51 and the rotor teeth 48A to 48D move within the guide groove 52 and then rotate about the axis as a result of the rotor teeth 48A to 48D meshing with the rack teeth 54A and 54B.

Figure 16:
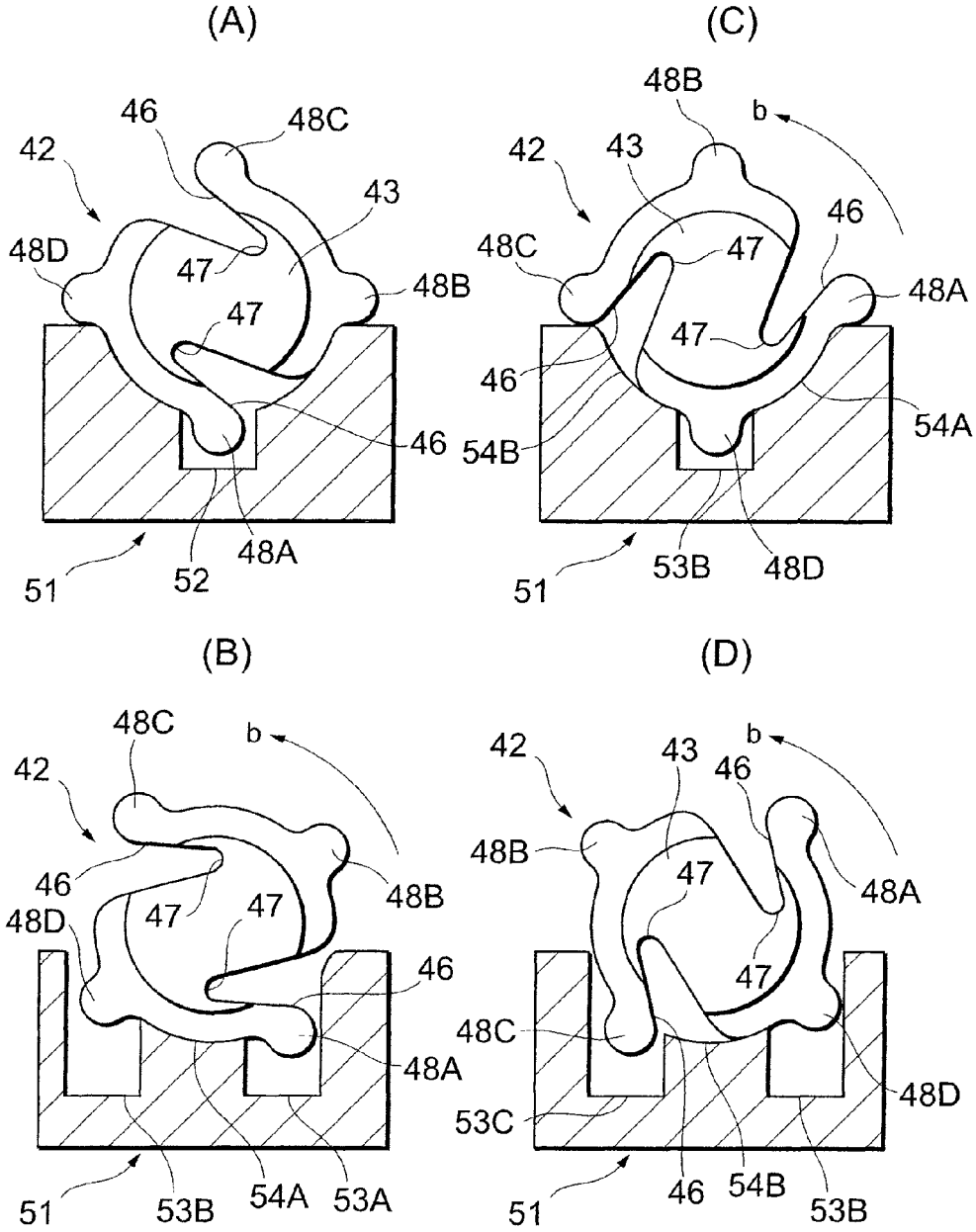
FIG. 16 provides cross-sectional views of the relationship between the rotational position of the rotor and the rack groove.

FIG. 15 is a planar view of the rack base in FIG. 14. FIG. 16 is a cross-sectional view of the relationship between the rotational position of the rotor and the rack grooves. (A) of FIG. 16 shows the state of the rotor 42 in the position of line $A_1$-$A_2$ in FIG. 15. (B) of FIG. 16 shows the state of the rotor 42 in a position of line $B_1$-$B_2$ in FIG. 15. (C) of FIG. 16 shows the state of the rotor 42 in a position of line $C_1$-$C_2$ in FIG. 15. (D) of FIG. 16 shows the state of the rotor 42 in a position of line $D_1$-$D_2$ in FIG. 15. (A) to (D) of FIG. 16 provide views from the left of FIG. 15 (from in front of the rotor 42 in the direction of motion).

The rotor 42 moves in the direction a shown in FIG. 15. As shown in (A) of FIG. 16, the rotor tooth 48A is in the guide groove 52 in the position of line $A_1$-$A_2$. When the rotor 42 advances further, the rotor tooth 48A butts against the rack tooth 54A and moves into the rack groove 53A as shown in (B) of FIG. 16. The rotor 42 then rotates about the axis and the rotor tooth 48D enters the rack groove 53B. The rotor 42 shown in (B) of FIG. 16 rotates 45 degrees from the state shown in (A) of FIG. 16.

When the rotor 42 advances further and reaches the position of line $C_1$-$C_2$, the rotor tooth 48D butts against the rack tooth 54B and moves into the rack groove 53B as shown in (C) of FIG. 16. The rotor 42 then enters a state which is assumed after rotating 45 degrees from the state shown in (B) of FIG. 16.

When the rotor 42 advances further and reaches the position of line $D_1$-$D_2$, the rotor tooth 48C moves into the rack groove 53C as shown in (D) of FIG. 16. The rotor 42 then enters a state which is assumed after rotating 45 degrees from the state shown in (C) of FIG. 16. Further, when the rotor 42 advances further and reaches the position of line $E_1$-$E_2$, the rotor 42 enters the state shown in (A) of FIG. 16 and enters a state which is assumed after rotating 45 degrees from the state shown in (D) of FIG. 16. The knitting mechanism of the rotor 42 is the same as the spiral system of the first embodiment mentioned earlier.

The rotor and driving method (driving device) according to the second embodiment provide the same operation and effect as the first embodiment. Furthermore, in the second embodiment, because grooves (guide groove 52 and rack grooves 53A to 53C) as guide portion are formed, machining is straightforward in comparison with a case where rails are formed as guide portions. In addition, when the guide portions are grooves, changes to the path followed can be easily made by adding and forming new grooves. The rack base 51 of the second embodiment is formed linear but may also be made circular in order to form an orbit as per the rail base 21 of the first embodiment.

Figure 17:
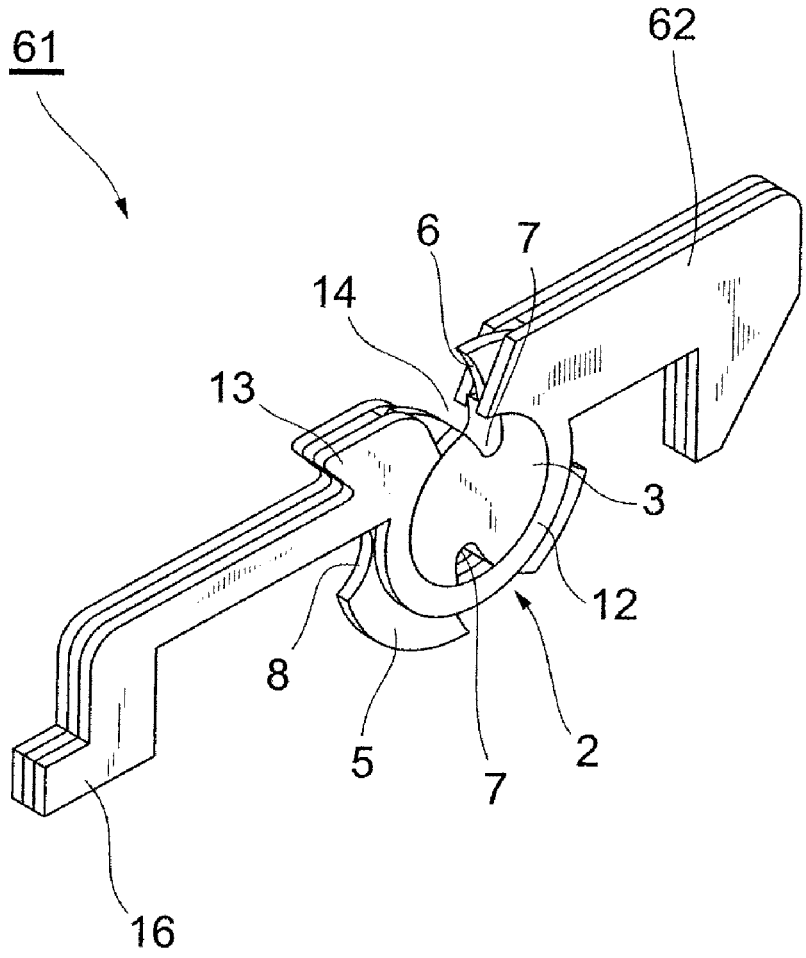
FIG. 17 is a perspective view of a knitting rotor according to a third embodiment of the present invention.
Figure 18:
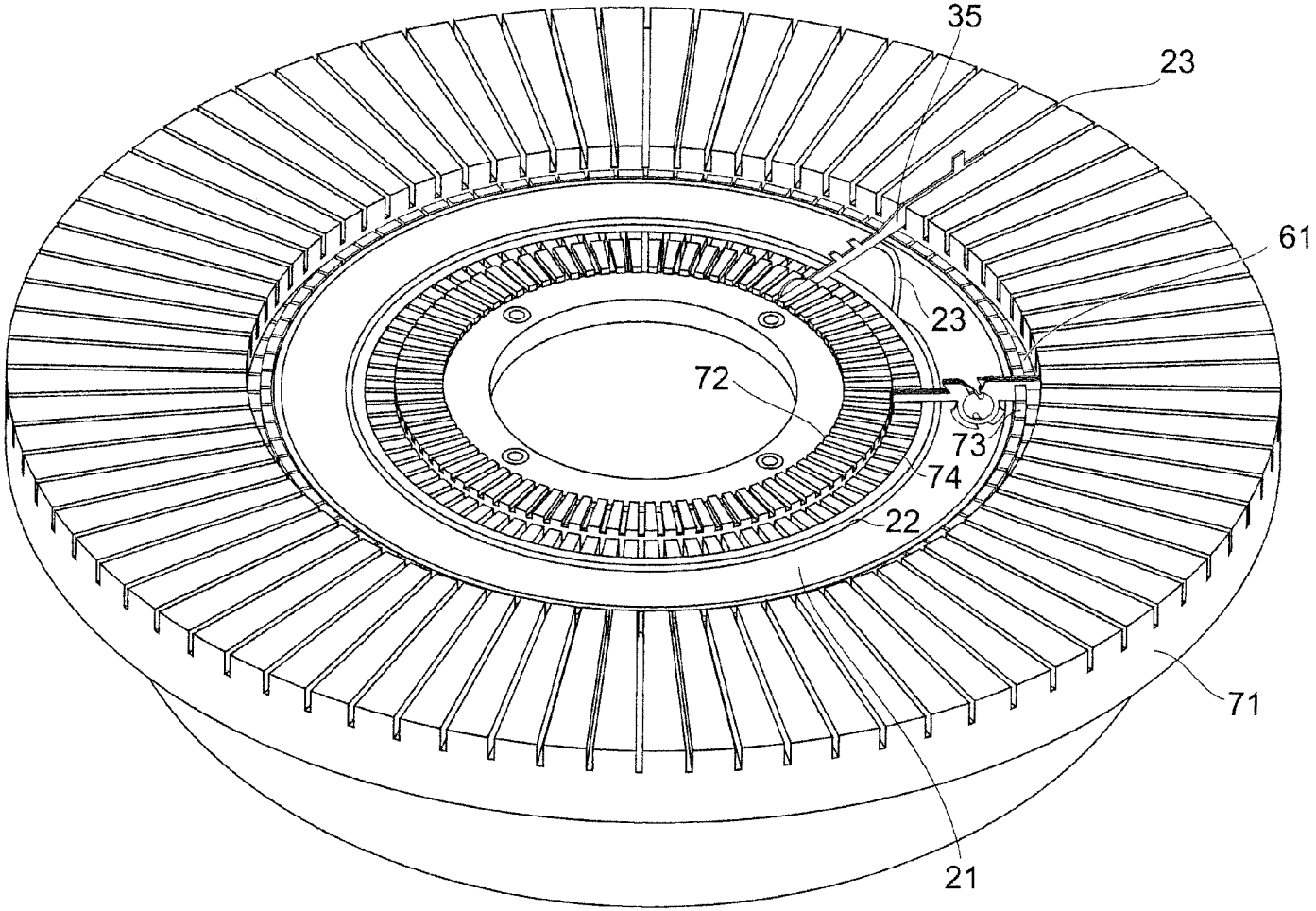
FIG. 18 is a perspective view of a circular knitting machine which comprises a knitting rotor according to a third embodiment of the present invention.
Figure 19:
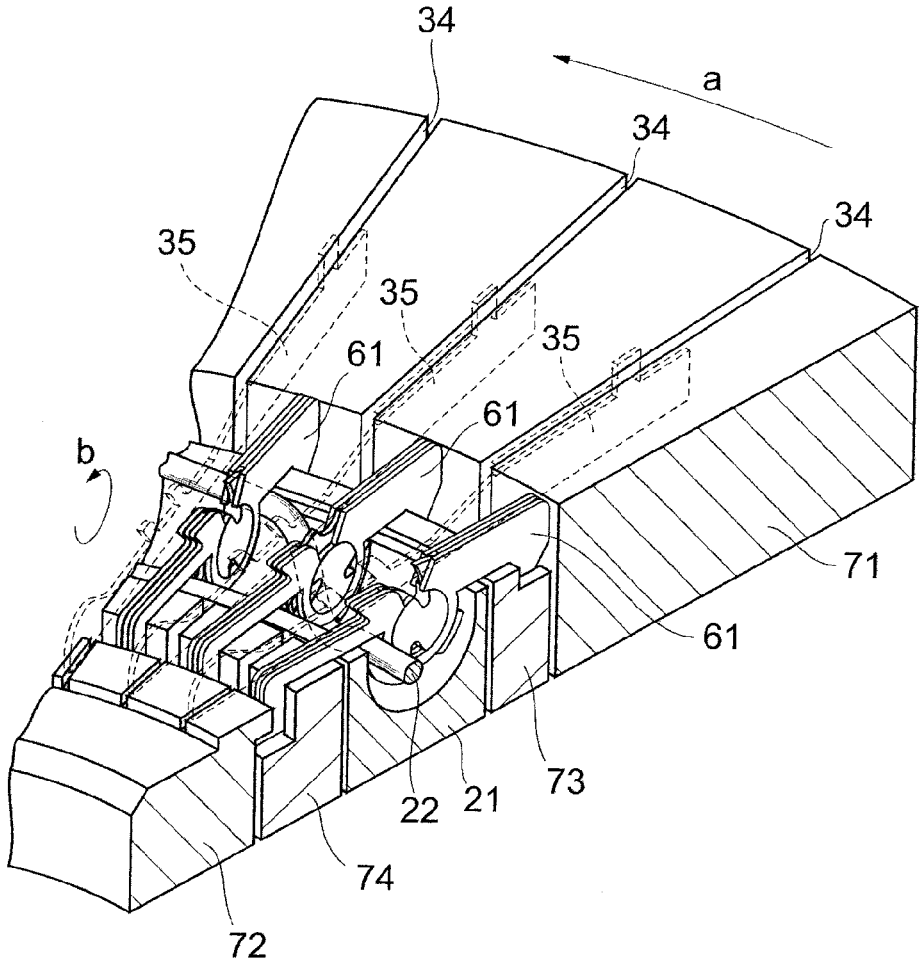
FIG. 19 is a cross-sectional perspective view of a circular knitting machine according to the third embodiment of the present invention.

A knitting rotor according to a third embodiment of the present invention and a circular knitting machine which comprises the knitting rotor will subsequently be described with reference to the drawings. FIG. 17 is a perspective view of the knitting rotor according to the third embodiment of the present invention. FIG. 18 is a perspective view of a circular knitting machine comprising the knitting rotor according to the third embodiment of the present invention. FIG. 19 is a cross-sectional perspective view of a circular knitting machine according to the third embodiment of the present invention.

A knitting rotor 61 (knitting element) of the third embodiment shown in FIG. 17 differs from the knitting rotor 1 of the first embodiment in that the knitting rotor 61 comprises a short holder 62 in place of the long holder 11. Furthermore, the circular knitting machine of the third embodiment shown in FIGS. 18 and 19 differs from the circular knitting machine of the first embodiment (see FIG. 6) in that holder bases 73 and 74 supporting the knitting rotor 61 and sinker beds 71 and 72 supporting the sinker 35 can be positioned and adjusted independently. Descriptions which are the same those of the first embodiment are omitted. Further, although one each of the knitting rotor 61 and sinker 35 are shown in FIG. 18, a plurality of knitting rotors 61 and sinkers 35 are actually disposed alternately.

As shown in FIG. 19, an inner sinker bed B72, an inner holder base 74, a rail base 21, an outer holder base 73, and an outer sinker bed B71 are sequentially disposed in the circular knitting machine of the third embodiment starting from the center thereof.

A groove for supporting the tip of the sinker 35 is formed in the inner sinker bed B72. A groove for supporting the holder tip 16 of the knitting rotor 61 is formed in the inner holder base 74. A guide rail 22 and spiral rail 23 are formed in the rail base 21 as mentioned earlier. A holder slot for supporting the trailing end of the knitting rotor 61 is formed in the outer holder base 73. Sinker slots 34 are formed in the outer sinker bed B71.

The holder 62 of the knitting rotor 61 is constituted to be inserted between the outer sinker bed B71 and the inner sinker bed B72 and shorter in length than the holder 11 of the knitting rotor 1.

The rail base 21 is fixed to a base (not shown). The inner and outer sinker beds B72 and B71 respectively and the inner and outer holder bases 74 and 73 respectively are constituted to be capable of moving rotatably in sync in a horizontal direction (about a second axis which extends in a vertical direction). Furthermore, the inner and outer sinker beds B72 and B71 and the inner and outer holder bases 74 and 73 are separate from one another and only the inner and outer sinker beds B72 and B71 are capable of individually moving vertically and of undergoing vertical positional adjustment.

The relationship between the vertical position of the knitting rotor 61 and the vertical position of the sinker 35 holding the stitch can accordingly be changed. In other words, this means that the distance between the hook bottom 7 at the lowermost point and the upper face of the sinker, which corresponds to the length of the loop, can be changed and that the length of the loop (that is, the stitch length) can be changed.

Thus, in a circular knitting machine of the third embodiment, because the holder slot and sinker slot 34 are formed cut into separate members, the sinker slot 34 alone may be formed in the inner and outer sinker beds B72 and B71, there being no need to form the holder slot in the sinker beds B71 and B72. Hence, because there is no need to cut both grooves (holder slot and sinker slot) in the same member even with a tight gauge (even when there is a large number of knitting rotors per inch), an adequate thickness between the grooves can be secured and the strength of the inner and outer sinker beds B72 and B71 in which the grooves are formed can be ensured.

Figure 20:
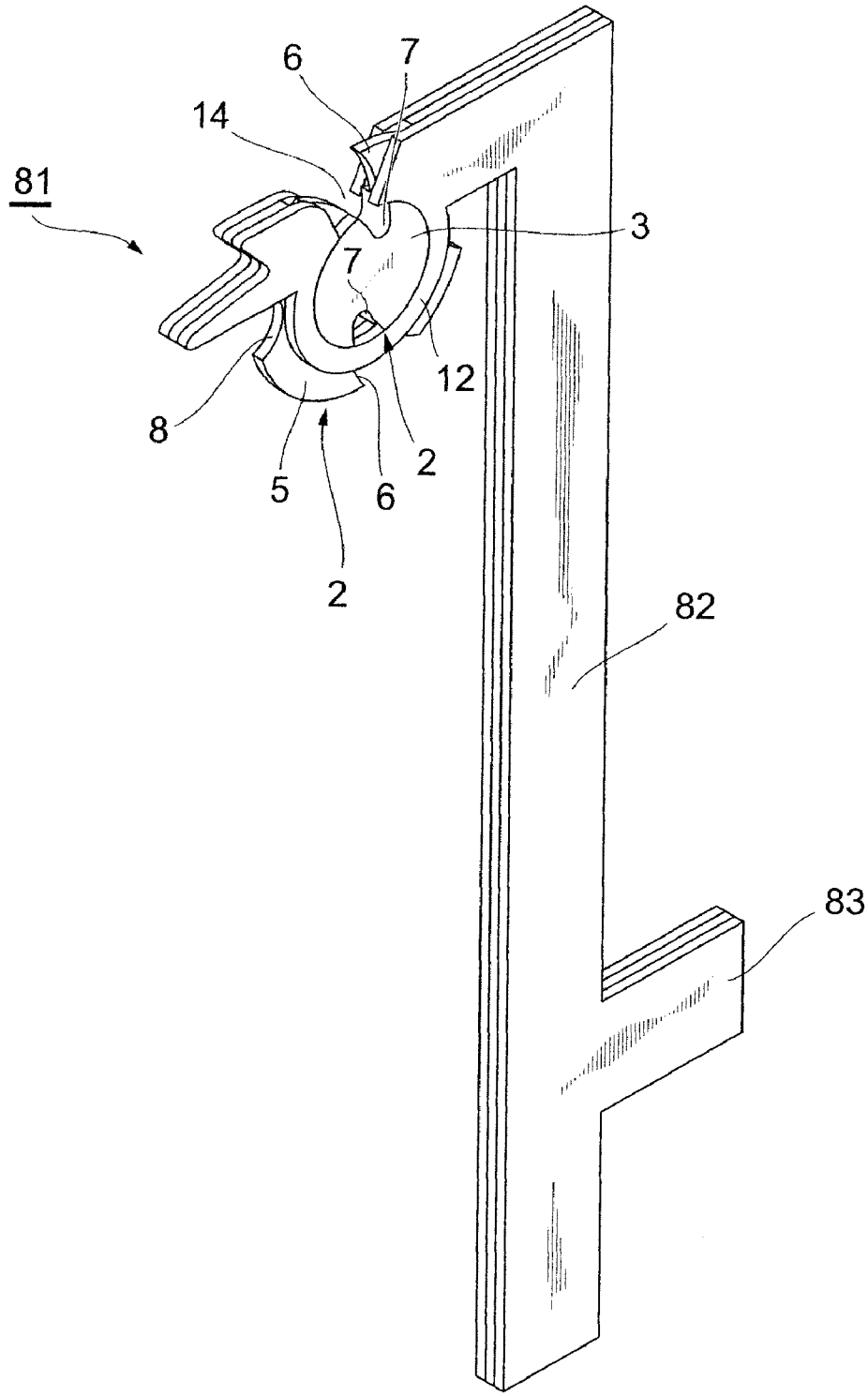
FIG. 20 is a perspective view of a knitting rotor according to a fourth embodiment of the present invention.
Figure 21:
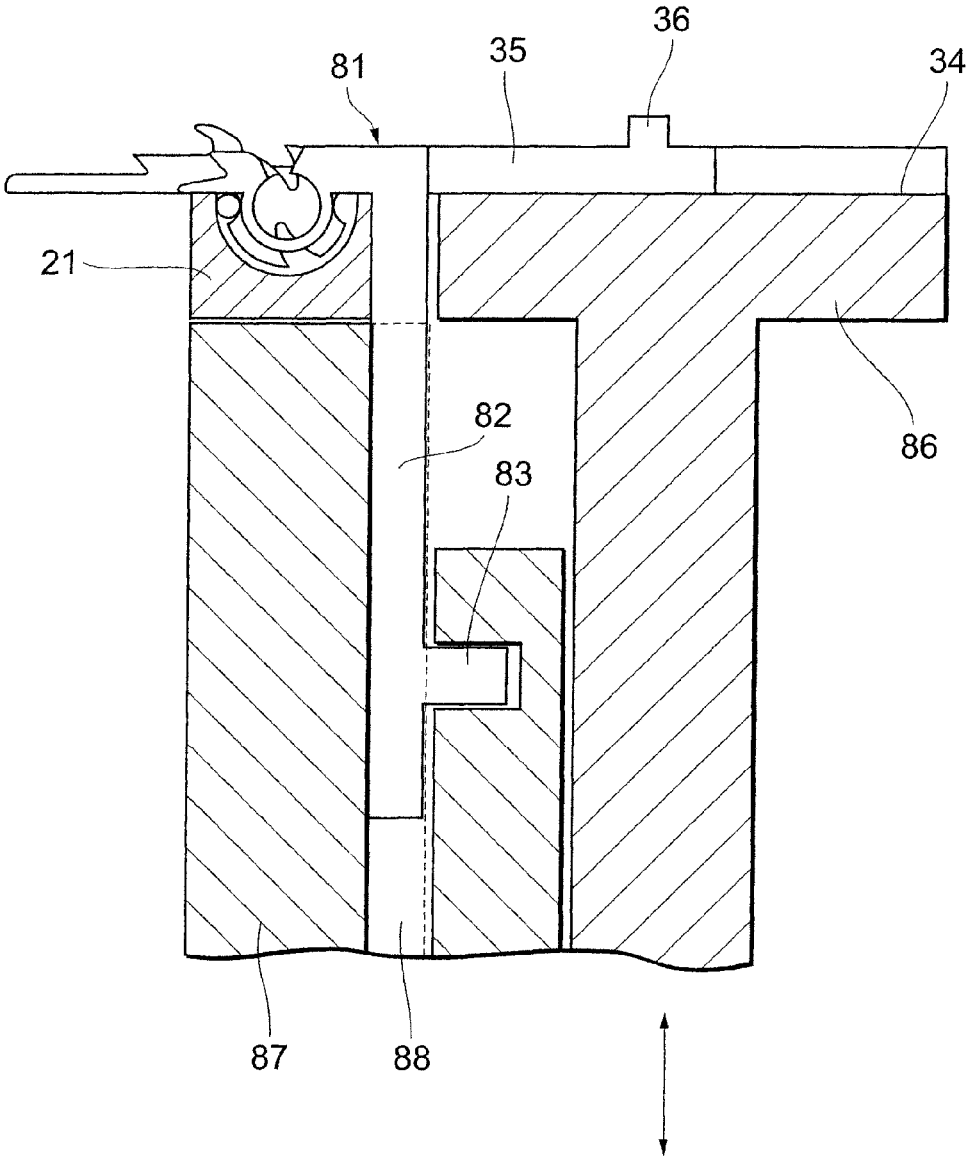
FIG. 21 is a cross-sectional view of a circular knitting machine comprising the knitting rotor according to the fourth embodiment of the present invention.

A knitting rotor according to a fourth embodiment of the present invention and a circular knitting machine which comprises the knitting rotor will be subsequently described with reference to the drawings. FIG. 20 is a perspective view of a knitting rotor according to the fourth embodiment of the present invention. FIG. 21 is a cross-sectional view of a circular knitting machine comprising the knitting rotor according to the fourth embodiment of the present invention.

The knitting rotor 81 (knitting element) of the fourth embodiment shown in FIG. 20 differs from the knitting rotor 61 of the third embodiment in that the knitting rotor 81 comprises an L-shaped holder 82 in place of the short holder 62. The L-shaped holder 82 comprises a short portion which has the holder bearing 12 and extends in a horizontal direction and a long portion which has a holder pad 83 and extends in a vertical direction.

As shown in FIG. 21, the rail base 21 and sinker bed C86 are sequentially disposed in the circular knitting machine of the fourth embodiment starting from the center thereof, and a cylinder 87 is disposed below the rail base 21.

The sinker slot 34 is formed in the sinker bed C86. This sinker slot 34 is formed in a lateral direction in FIG. 21. A groove 88 which extends vertically is formed in the cylinder 87 (called the 'cylinder slot' hereinbelow). The long portion of the holder 82 is inserted into and fixed to the cylinder slot 88.

The rail base 21 is fixed to the base (not shown). The sinker bed C86 and the cylinder 87 are constituted so as to be capable of moving rotatably in sync in a horizontal direction (about a second axis which extends in a vertical direction). Furthermore, the sinker bed C86 and cylinder 87 are separate from one another, where only the sinker bed C86 is capable of moving independently in a vertical direction and of undergoing vertical positional adjustment.

The relationship between the vertical position of the knitting rotor 81 and the vertical position of the sinker 35 holding the stitch can accordingly be changed. In other words, this means that the distance between the hook bottom 7 at the lowermost point and the upper face of the sinker, which corresponds to the length of the loop, can be changed and that the length of the loop (that is, the stitch length) can be changed.

Thus, in a circular knitting machine of the fourth embodiment, because the cylinder slot 88 holding the holder and the sinker slot 34 are formed cut into separate members, the sinker slot 34 alone may be formed in the sinker bed C86, there being no need to form the groove (cylinder slot 88) for holding the holder in the sinker bed C86. Hence, because there is no need to cut both grooves (cylinder slot 88 and sinker slot 34) in the same member even with a tight gauge (even when there is a large number of knitting rotors per inch), an adequate thickness between the grooves can be secured and the strength of the sinker bed C86 in which the grooves are formed can be ensured.

Figure 22:
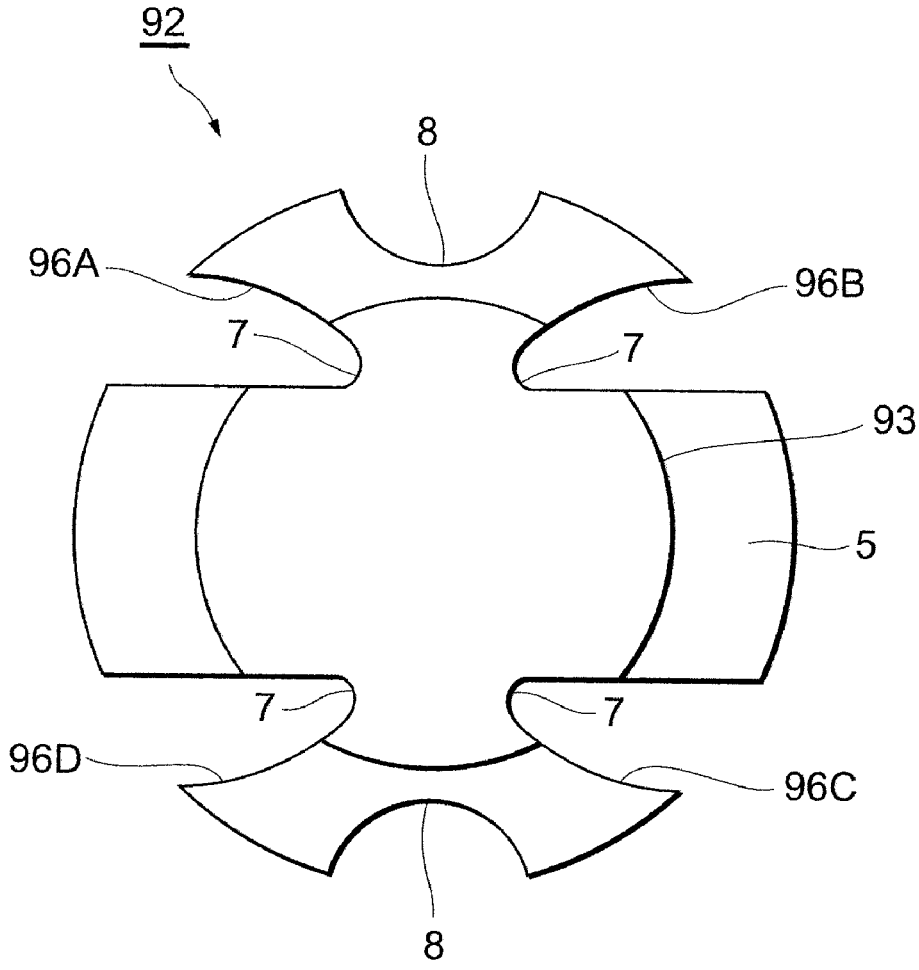
FIG. 22 is a front view of a rotor according to a fifth embodiment of the present invention.

A knitting rotor according to a fifth embodiment of the present invention will be described next with reference to the drawings. FIG. 22 is a front view of the rotor according to a fifth embodiment of the present invention. The knitting rotor of the fifth embodiment differs from the knitting rotor 1 of the first embodiment in that the rotor shape is different and in comprising a rotor shaft 93 (rotating shaft) in place of the rotor 2 in which the two hooks 6 are formed and comprising a rotor 92 in which four hooks 96A to 96D are formed. Description which is the same as that of the first embodiment will be omitted.

The rotor (four-hook rotor) 92 shown in FIG. 22 has the four hooks 96A to 96D formed in the rotor blade 5. The rotor 92 is able to make a face stitch 212A and a back stitch 212B (see FIG. 25) by controlling the rotational direction (positive and negative rotation).

Figure 23:
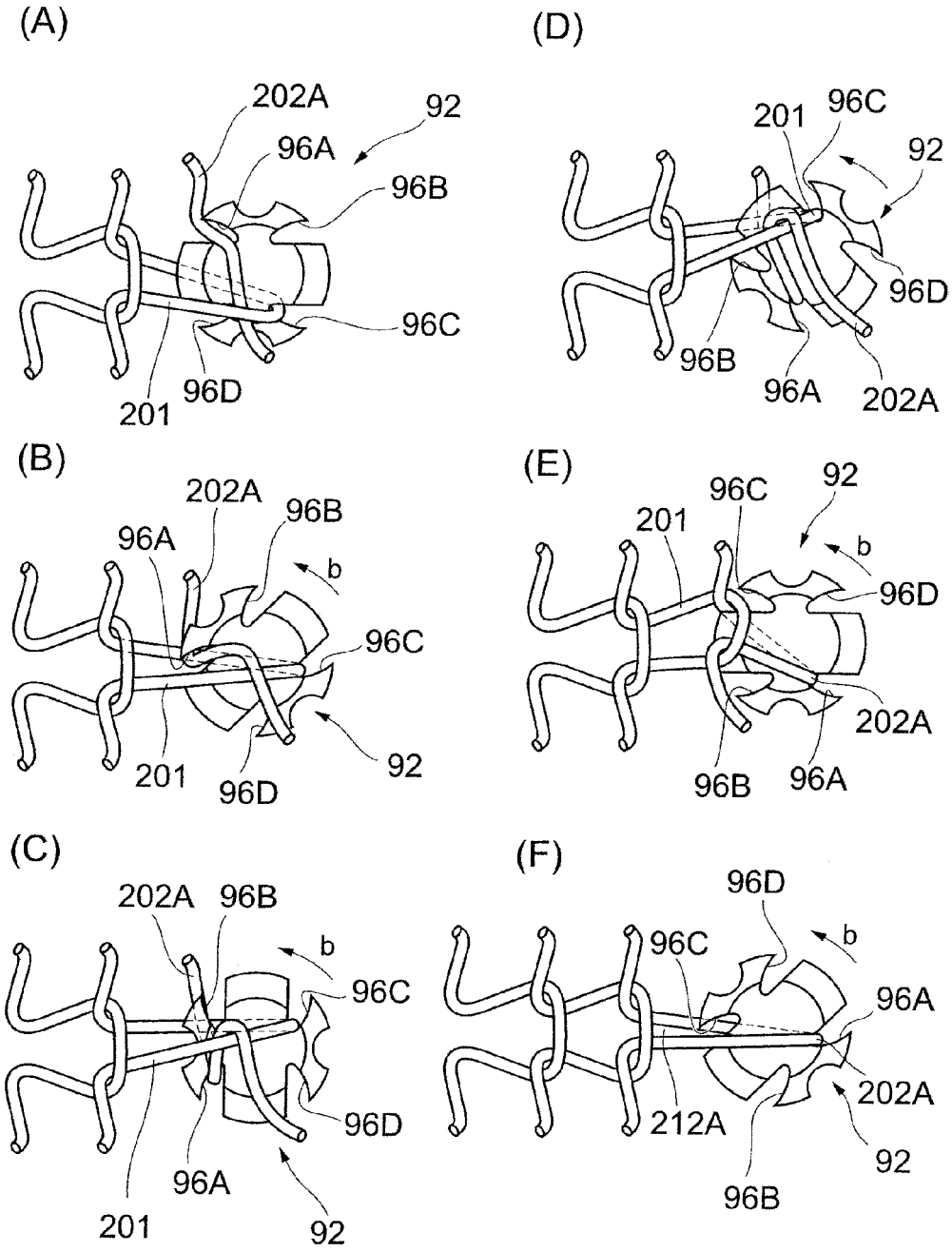
FIG. 23 shows a knitting cycle which employs the rotor according to the fifth embodiment of the present invention.
Figure 24:
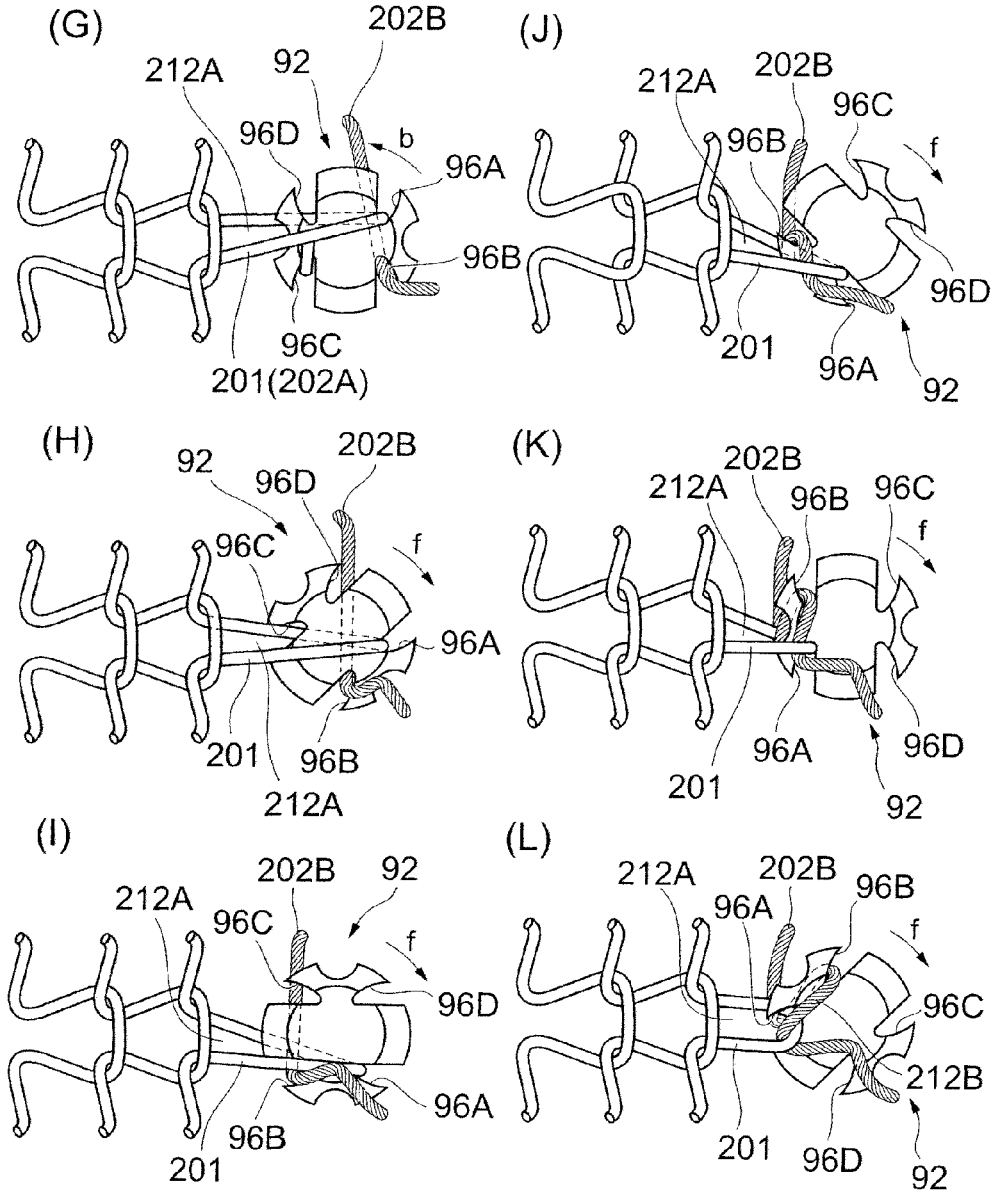
FIG. 24 shows the knitting cycle which employs the rotor according to the fifth embodiment of the present invention.
Figure 25:
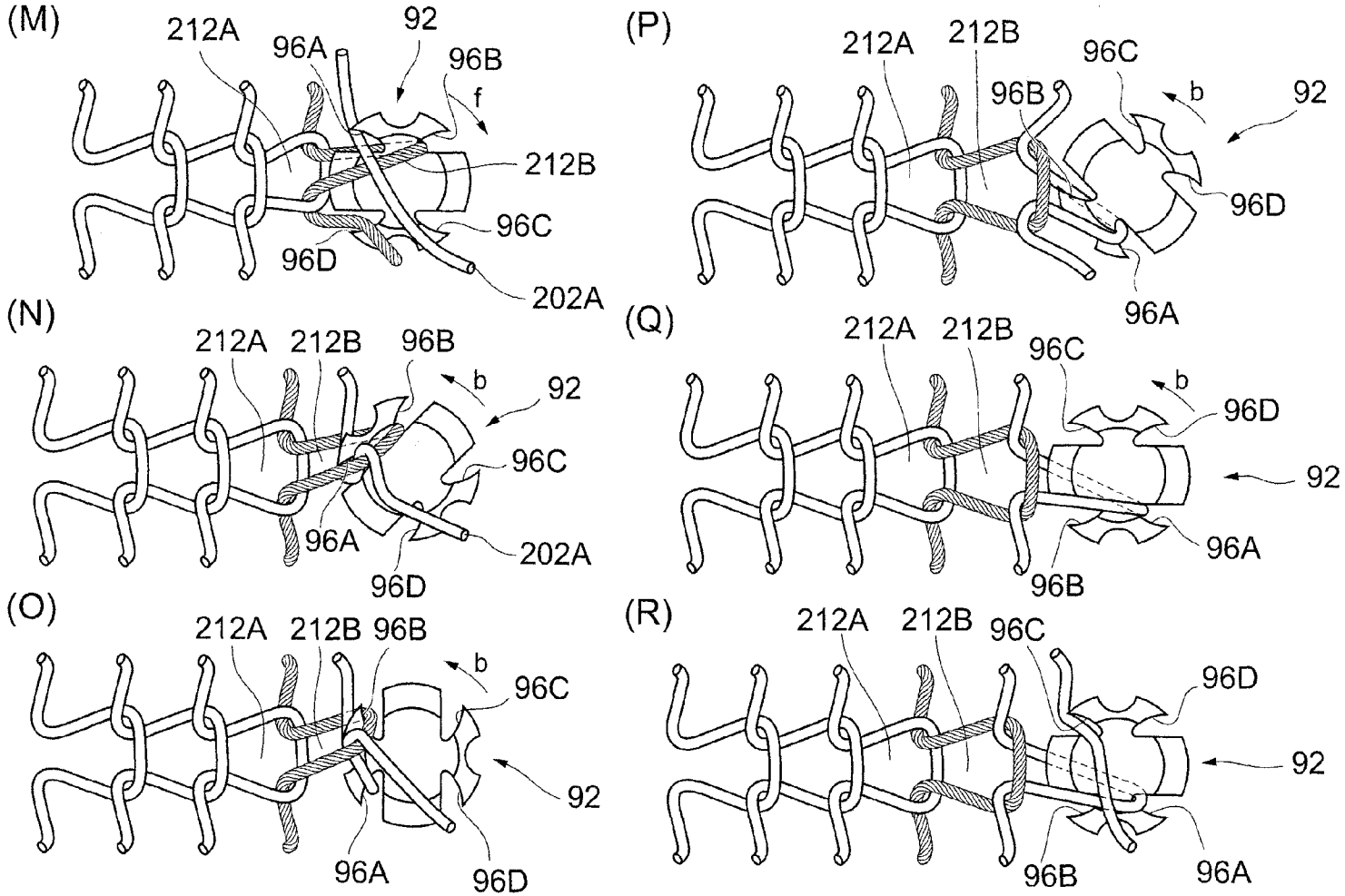
FIG. 25 shows the knitting cycle which employs the rotor according to the fifth embodiment of the present invention.

A knitting method which employs the rotational motion of the rotor 92 (knitting fabrication method) will be described next. FIGS. 23 to 25 show the knitting cycle which employs the rotor according to the fifth embodiment of the present invention. The rotor 92 rotates and moves in the direction of arrow b (counterclockwise in FIGS. 23 to 25).

The position of the rotor 92 shown in (A) of FIG. 23 will now be described as a reference rotational position (0 degree). As shown in (A) of FIG. 23, when the rotor 92 is in the 0 degree position (origin), a knitting yarn 202A is supplied to the rotor 92. Here, the old loop 201 is in a state of being engaged in the hook bottom 7 of the lower hook 96C.

The rotor 92 rotates through 45 degrees from the 0 degree position shown in (A) of FIG. 23 and assumes the state shown in (B) of FIG. 23. When the rotor 92 rotates from the 0 degree position to the 45 degree position, the knitting yarn 202A (new loop) is received (caught) by the upper hook 96A.

Likewise, (C), (D), (E) and (F) of FIG. 23 show the state of the rotor 92 at rotational angles of 90 degrees, 135 degrees, 180 degrees, and 225 degrees respectively. In this case, a loop is formed in the same way as with the rotor 2. The loop 202A formed here passes from above the old loop 201 to below the old loop 201 as shown in (C) to (F) of FIG. 23, thereby forming a stitch. That is, the face stitch 212A is made.

(G) of FIG. 24 shows the state of the rotor 92 at a rotational angle of 270 degrees. Here, in (G) to (L) of FIG. 24, the knitting yarn (new loop) 202A in (F) of FIG. 23 is the old loop 201. The rotor 92 receives a new knitting yarn 202B (new loop) by means of a lower hook 96B in rotating from a position at a rotational angle of 225 degrees to a 270 degree position. At this point, the rotation (positive rotation) of rotor 92 in the direction of arrow b switches to rotation (negative rotation) in the direction of arrow f.

The rotor 92 rotates 45 degrees in direction f from the 270 degree position shown in (G) of FIG. 24 and enters the state of the rotational angle 225 degrees shown in (H) of FIG. 24. Likewise, (I), (J), (K), and (L) of FIG. 24 show the state of the rotor 92 at rotational angles of 180 degrees, 135 degrees, 90 degrees, and 45 degrees respectively. The rotor 92 continues to rotate in direction f from the state shown in (H) of FIG. 24 and enters the states shown in (I) to (L) of FIG. 24. Here, the rotor 92 forms a loop. The loop 202B formed here passes from above the old loop 201 to below the old loop 201 as shown in (I) to (L) of FIG. 24, thereby forming a stitch. That is, the back stitch 212B is made.

(M) of FIG. 25 shows the state of the rotor 92 at a rotational angle of 0 degrees. The rotor 92 continues to rotate in direction f from the position at a rotational angle of 45 degrees and returns to the 0 degree position. At this point, the rotation of the rotor 92 in the f direction (negative rotation) stops and switches once again to rotation in the b direction (positive rotation).

When the rotor 92 rotates from the 0 degree position to the 45 degree position shown in (N) of FIG. 25, the knitting yarn 202A (new loop) is received by the upper hook 96A.

Likewise, (O) and (P) of FIG. 25 show the state of the rotor 92 at rotational angles of 90 degrees and 135 degrees respectively and (Q) and (R) of FIG. 25 show the state of the rotor 92 at a rotational angle of 180 degrees. As shown in these drawings, the back stitch 212B is formed in passing from above the face stitch 212A to below the face stitch 212A. That is, by using four hook rotors 92 to control the direction of rotation, the face stitch 212A and back stitch 212B can be optionally made.

Figure 26:
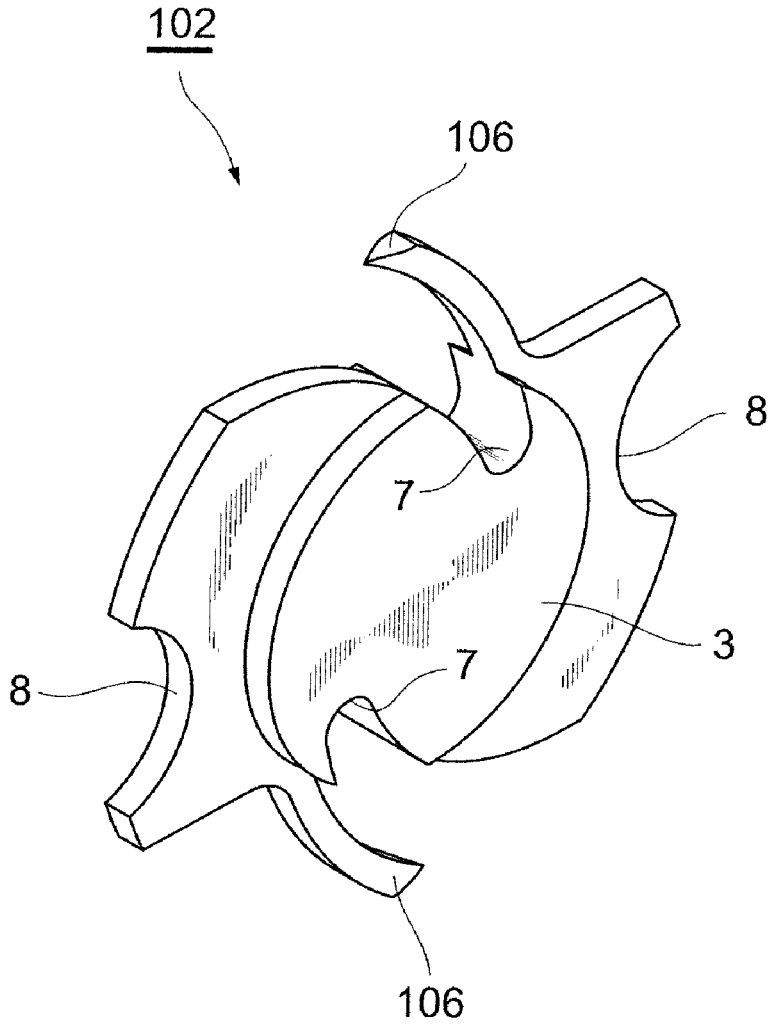
FIG. 26 is a perspective view of a rotor according to a sixth embodiment of the present invention.

A knitting rotor according to a sixth embodiment of the present invention will be described next with reference to the drawings. FIG. 26 is a perspective view of the rotor according to the sixth embodiment of the present invention. The knitting rotor of the sixth embodiment differs from the knitting rotor 1 of the first embodiment in that the rotor shape is different and in that the knitting rotor of the sixth embodiment comprises spring-like hooks 106 (called 'spring hooks' hereinbelow). Description which is the same as that of the first embodiment will be omitted.

The rotor 102 (spring rotor) shown in FIG. 26 has spring hooks 106 formed in the rotor blade. The spring hooks 106 have a triangular cross-sectional shape, for example, and are flexible in the circumferential direction of the rotor 102. That is, the engagement recesses can be reduced by flexing the spring hooks 106 inward and the engagement recesses can be widened by flexing the spring hooks 106 outward. A spring rotor 102 of this kind is used to float (not engage) the knitting yarn.

Figure 27:
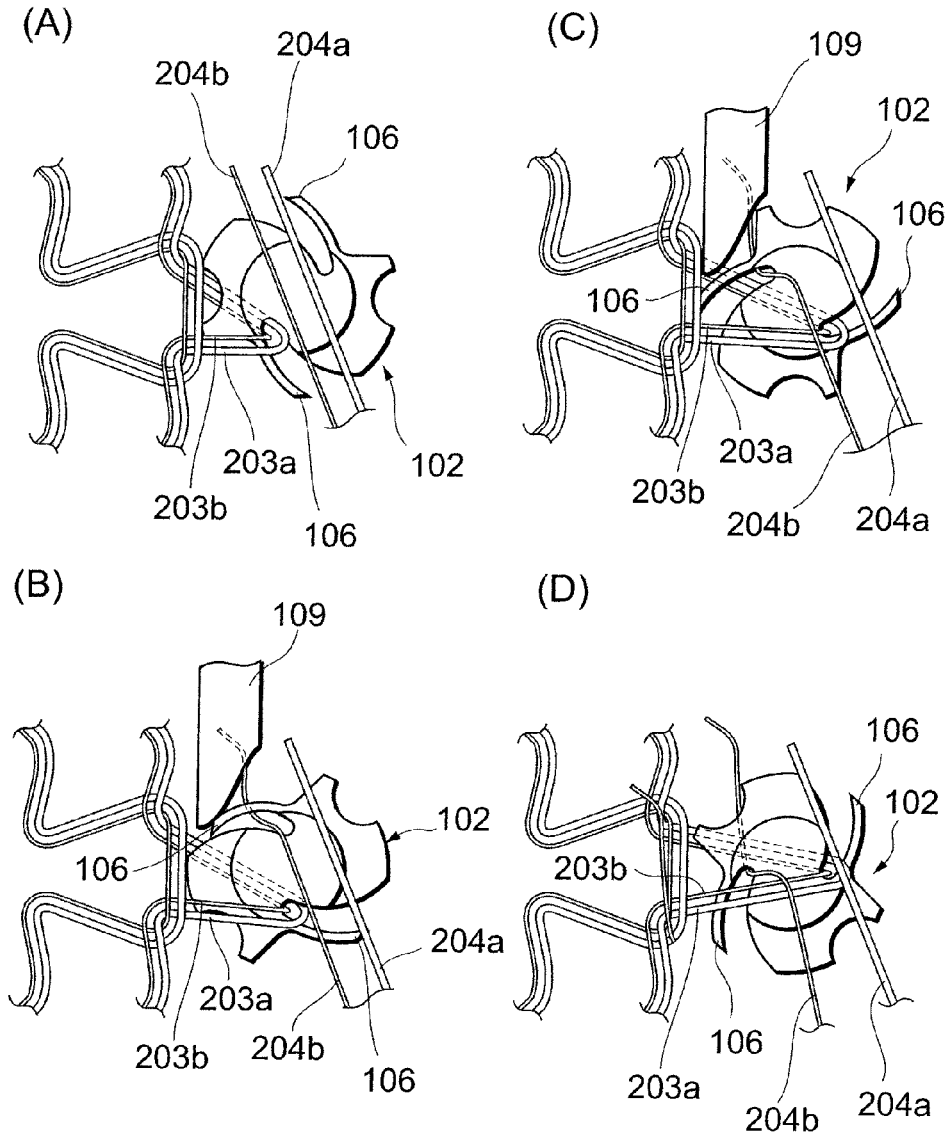
FIG. 27 shows a knitting cycle which employs a rotor according to the sixth embodiment of the present invention.

A knitting method which employs the rotational motion of the spring rotor 102 (knitting fabrication method) will be described next. FIG. 27 shows a knitting cycle which employs the rotor according to the sixth embodiment of the present invention.

The position of the spring rotor 102 shown in (A) of FIG. 27 will now be described as a reference rotational position (0 degree). As shown in (A) of FIG. 27, when the spring rotor 102 is in the 0 degree position (origin), the knitting yarns 204*a* and 204*b* are supplied to the spring rotor 102. Here, the upper spring hook 106 is in a state prior to receiving the knitting yarns 204*a* and 204*b* and in a state where old loops 203*a* and 203*b* are engaged in the hook bottom 7 of the lower spring hook 106. There are two knitting yarns and the face yarn 204*a* and the back yarn 204*b*, where the face yarn 204*a* used can be thicker than the back yarn 204*b*.

The spring rotor 102 rotates 45 degrees from the 0 degree position shown in (A) of FIG. 27 and enters the state shown in (B) of FIG. 27. The spring rotor 102 enters a half-open state as a result of the upper spring hook 106 being pushed by a presser 109 when the spring rotor 102 rotates and moves from the 0 degree position to the 45 degree position and only the back yarn 204*b* is knitted (caught). Here, the face yarn 204*a* is skipped and not caught on the spring hook 106.

Likewise, (C) and (D) of FIG. 27 show states where the spring rotor 102 is at rotational angles of 90 degrees and 135 degrees respectively and where the back yarn 204*b* passes through the old loops 203*a* and 203*b*. Here, the face yarn 204*a* remains floated.

When the presser 109 is not operated, the spring hooks 106 are in an open state and, in rotating and moving from the 0 degree position to the 45 degree position, both the face yarn 204*a* and the back yarn 204*b* are knitted by the upper spring hook 106. A normal plain stitch can accordingly be made. Thus, a spiral float (spiral mesh) knitted structure can be made by knit and miss stitches.

Figure 28:
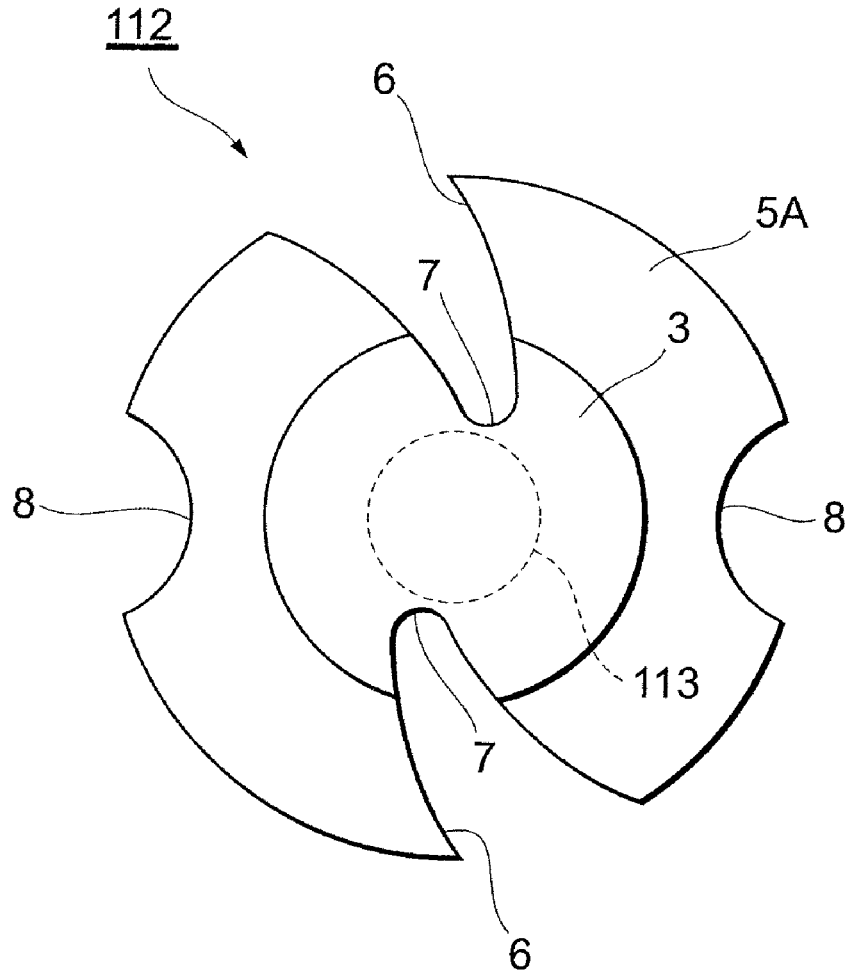
FIG. 28 is a front view of a rotor according to a seventh embodiment of the present invention.
Figure 29:
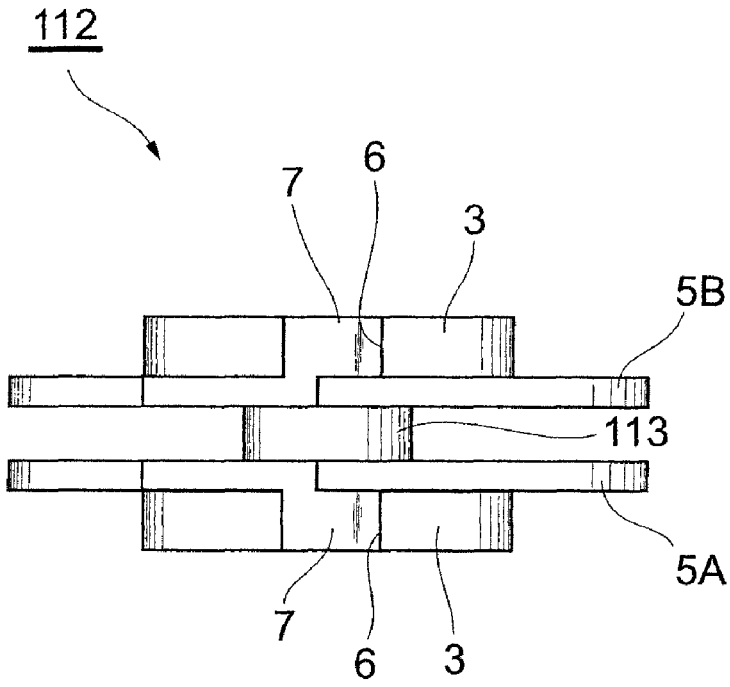
FIG. 29 is a planar view of the rotor according to the seventh embodiment of the present invention.

A knitting rotor according to a seventh embodiment of the present invention will be described next with reference to the drawings. FIG. 28 is a front view of the rotor according to a seventh embodiment of the present invention. FIG. 29 is a planar view of the rotor according to the seventh embodiment of the present invention. The knitting rotor according to the seventh embodiment differs from the knitting rotor 1 of the first embodiment in comprising a rotor 112 having two rotor main bodies 5A and 5B (called a 'double rotor' hereinbelow).

The double rotor 112 shown in FIGS. 28 and 29 has two rotor main bodies 5A and 5B disposed facing one another. A rotor axis 113 which is coaxial with the rotor shaft 3 is provided between the two rotor main bodies 5A and 5B. The rotor axis 113 has a smaller diameter than the rotor shaft 3. The two rotor main bodies 5A and 5B are disposed at the same angle opposite one another as in a mirror image. That is, the hooks 6, hook bottoms 7, and rotor guides 8 provided on the rotor main bodies 5A and 5B are at the same rotational angle to one another.

Figure 30:
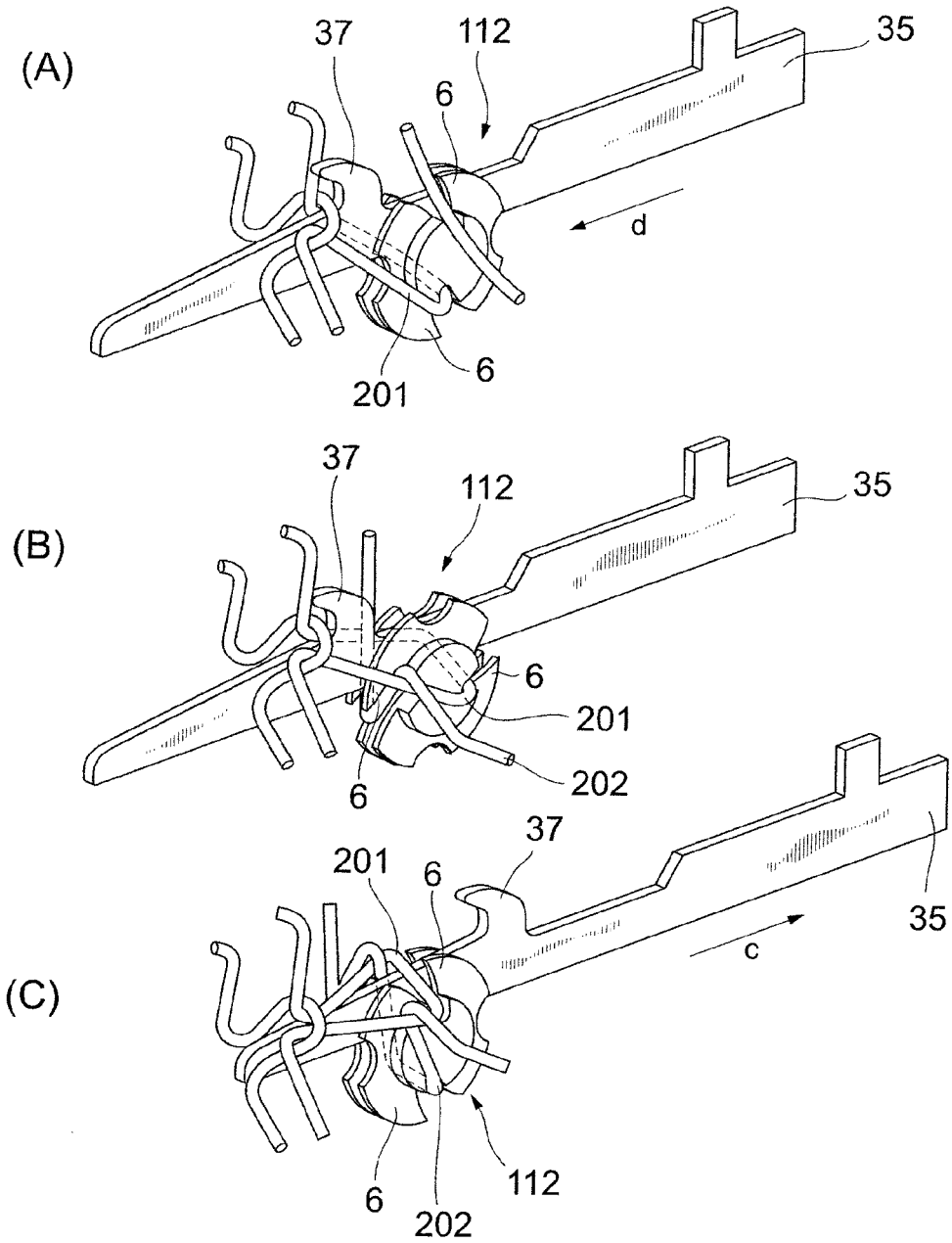
FIG. 30 shows a knitting cycle which employs the rotor according to the seventh embodiment of the present invention.

The action of the sinker with respect to the loop knitted by the double rotor 112 will be described next. FIG. 30 shows a knitting cycle which employs the rotor according to the seventh embodiment of the present invention. The sinker 35 is disposed right above the rotor axis 113 so as to cross the rotor axis 113 and is capable of sliding in the fore/aft direction (directions c and d in FIG. 30). The position of the double rotor 112 shown in (A) of FIG. 30 will be described as the reference rotational position (0 degree). The sinker 35 slides (advances) in the direction of the arrow d so as to pass within the loop of the old loop 201.

(B) of FIG. 30 shows a state of the double rotor 112 at a rotational angle of 90 degrees. Here, a sinker claw 37 is in a state of acting to allow a loop to escape and the left-hand hook 6 is in a state of receiving the new loop 202.

(C) of FIG. 30 shows a state of the double rotor 112 at a rotational angle of 180 degrees. Here, the sinker 35 retreats in the direction of the arrow c. Thus, the sinker 35 can be disposed between the pair of rotor main bodies 5A and 5B in the double rotor 112. Hence, the smooth escape of the loop and the loop formation can be realized by the sinker 35 disposed between the rotor main bodies 5A and 5B.

Figure 31:
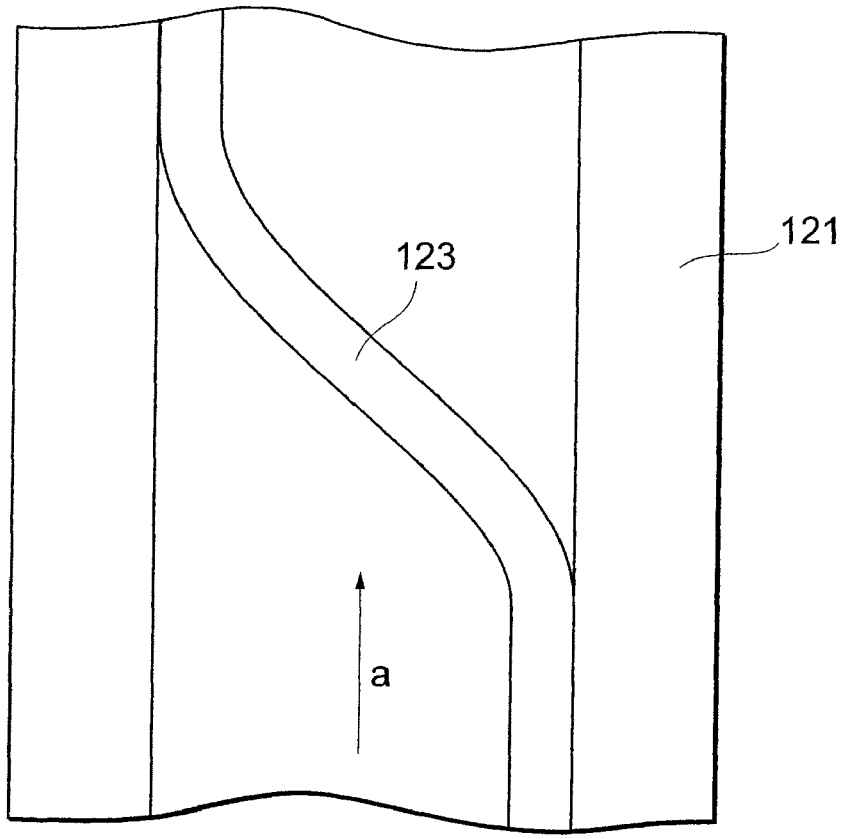
FIG. 31 is a planar view of a rail base according to a modified example of the present invention.
Figure 32:
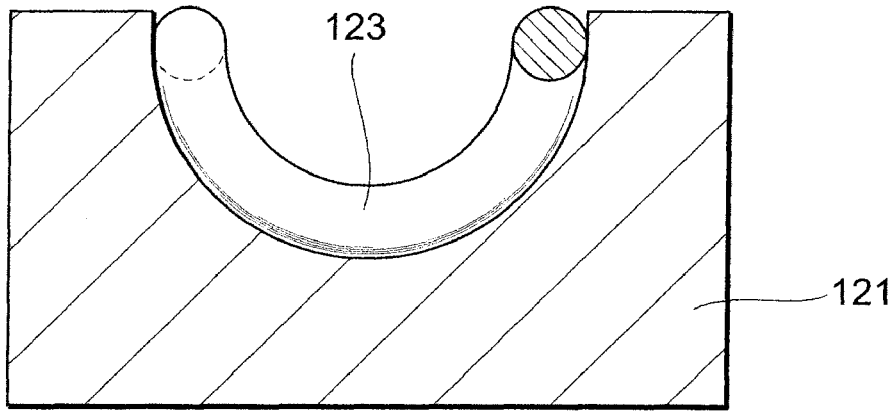
FIG. 32 is a cross-sectional view of the rail base according to the modified example of the present invention.

The rail base according to the modified example of the present invention will be described next. FIG. 31 is a planar view of a rail base according to a modified example of the present invention. FIG. 32 is a cross-sectional view of the rail base according to the modified example of the present invention. A spiral rail 123 is formed in the rail base 121 shown in FIG. 31 helically from the right side toward the left of FIG. 31. The spiral rail 123 is used in cases where four hook rotors 92 are made to rotate in a negative direction when the rotation of the rotor 2 by the spiral rail 23 is positive. The slide rail 123 is formed to rotate in a negative direction when the rotors slide in the direction a (shown). By connecting the spiral rail 23 used for positive rotation and the spiral rail 123 used for negative rotation with the guide rail 22 interposed therebetween, the four hook rotors 92 can be made to rotate in a negative direction after rotating in a positive direction. In a rack and pinion system, the rotors can be made to rotate in a negative direction by reversing the inclination direction of the slanted rack teeth.

Figure 33:
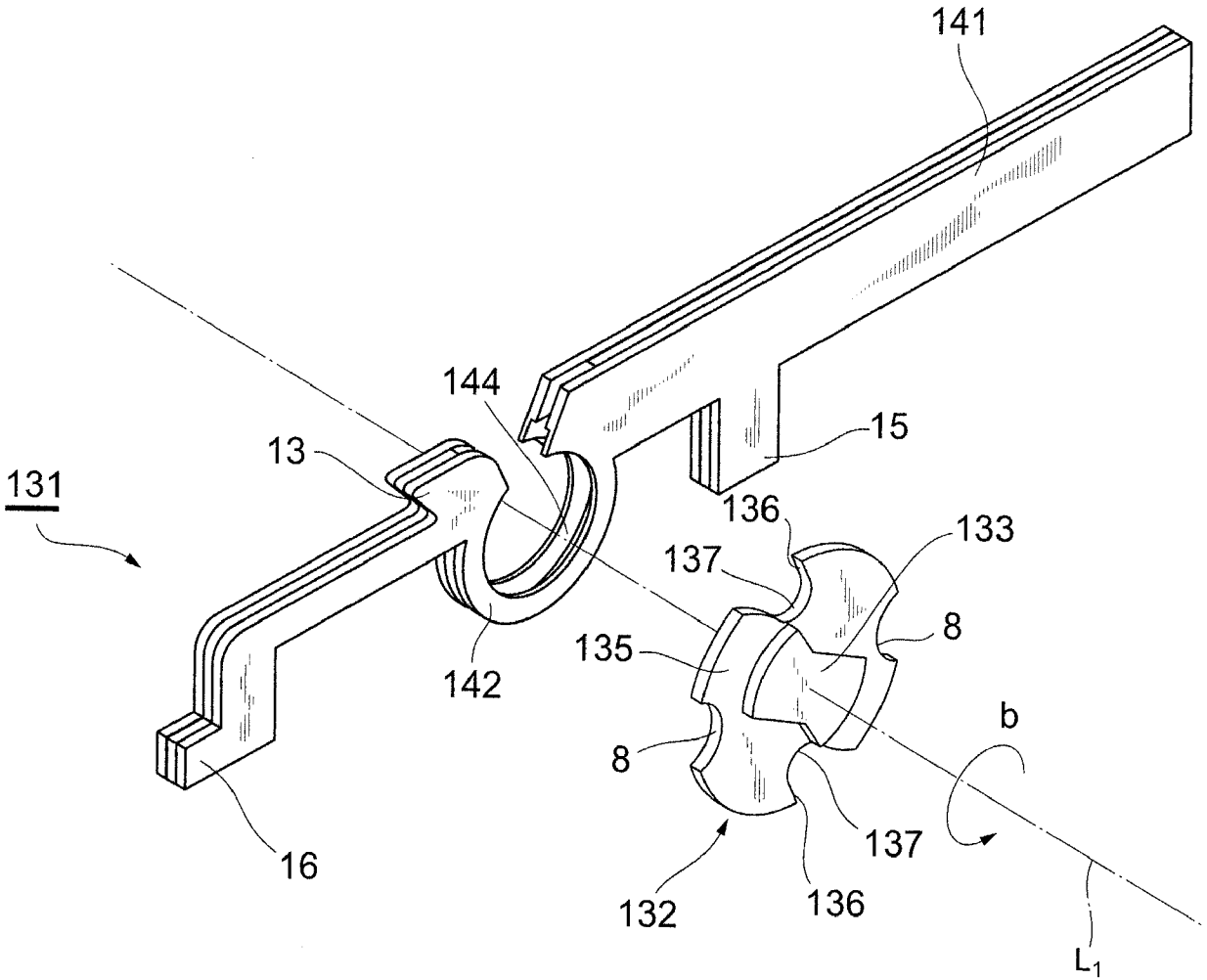
FIG. 33 is an exploded perspective view of a knitting rotor according to an eighth embodiment of the present invention.
Figure 34:
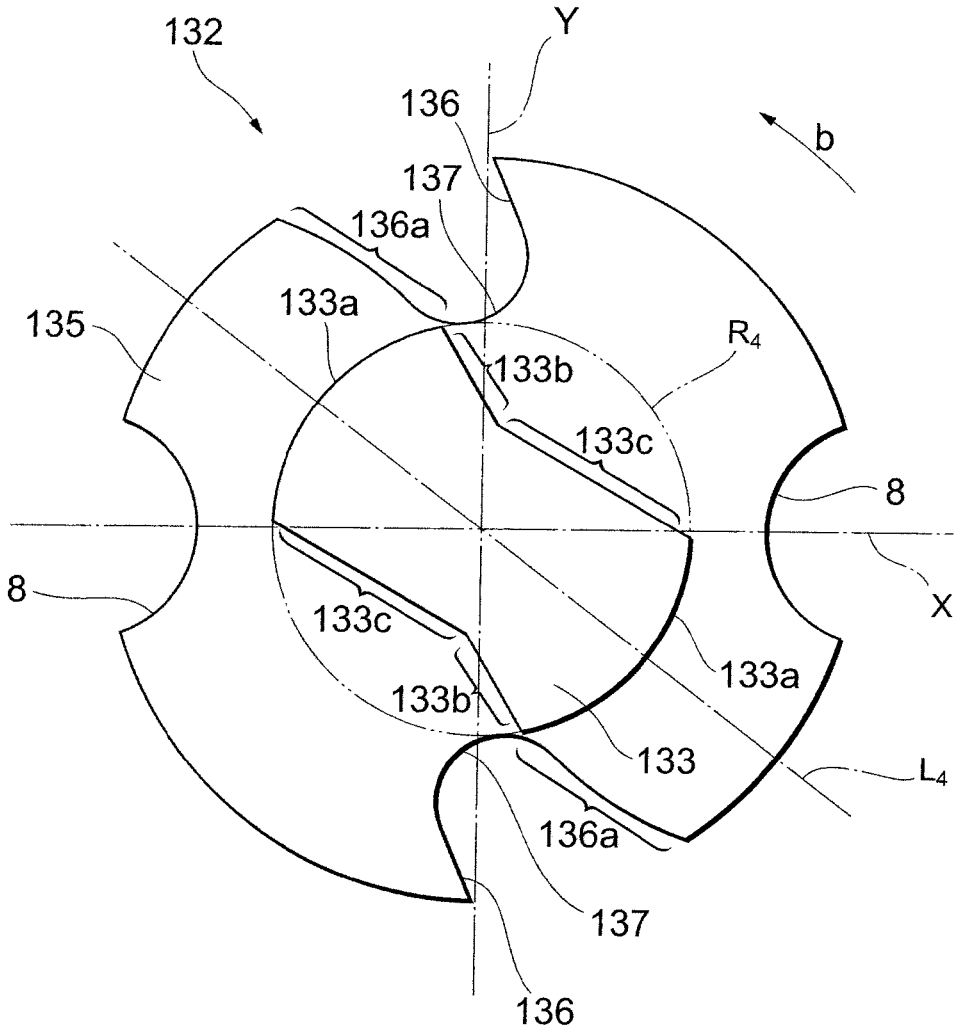
FIG. 34 is a front view of the rotor according to the eighth embodiment of the present invention.
Figure 35:
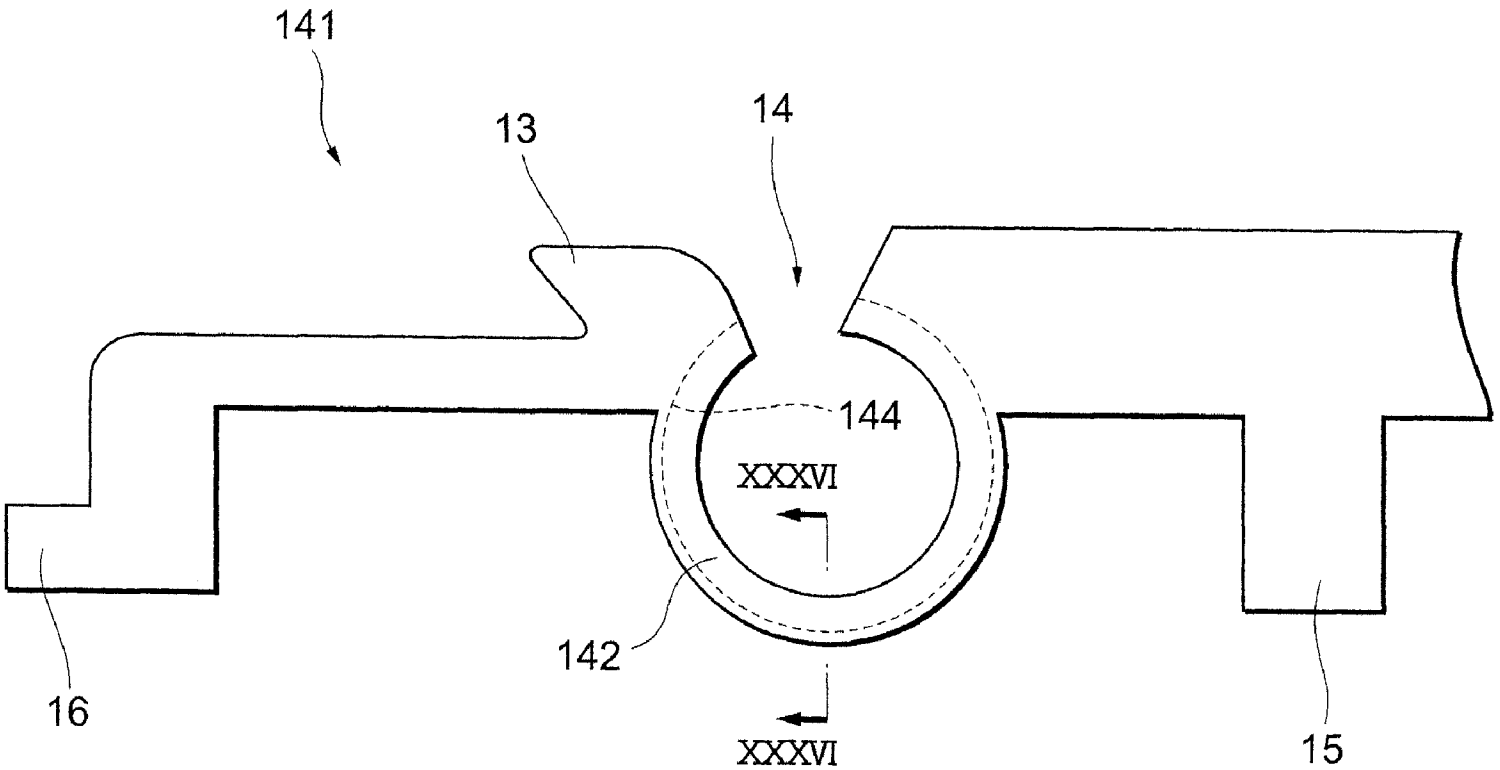
FIG. 35 is an essential part enlarged view of the holder in FIG. 33.
Figure 36:
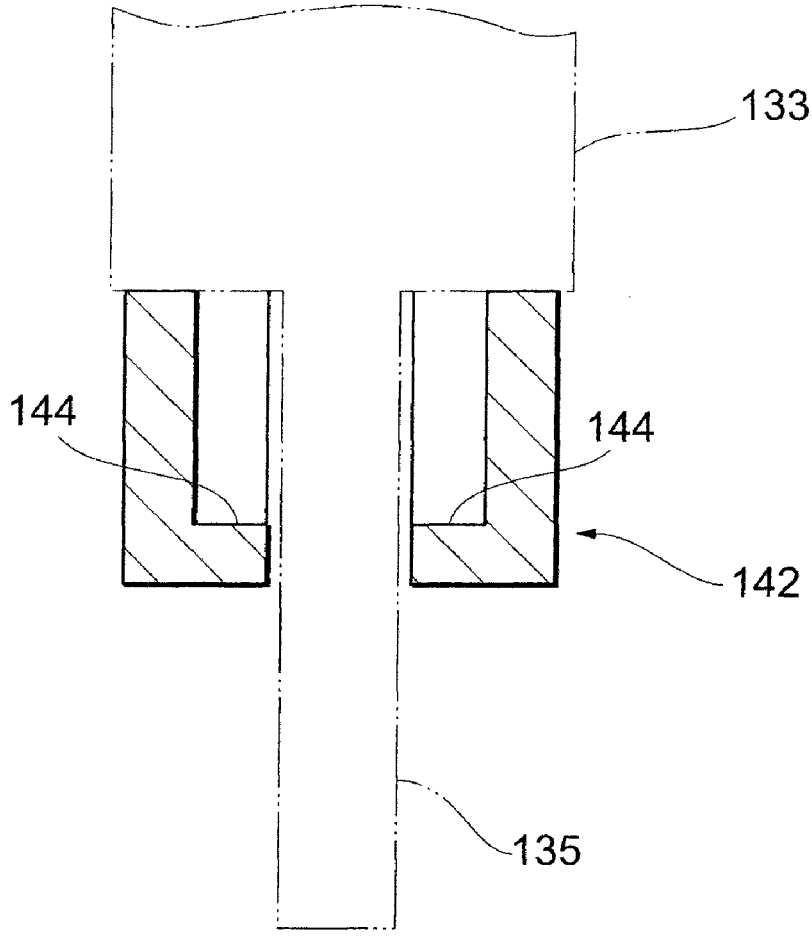
FIG. 36 is a cross-sectional view of the bearing in FIG. 35 along the line XXXVI-XXXVI.

A knitting rotor according to an eighth embodiment of the present invention will be described next with reference to the drawings. FIG. 33 is an exploded perspective view of a knitting rotor according to an eighth embodiment of the present invention. FIG. 34 is a front view of the rotor according to the eighth embodiment of the present invention. FIG. 35 is an essential part enlarged view of the holder in FIG. 33. FIG. 36 is a cross-sectional view of the bearing in FIG. 35 along the line XXXVI-XXXVI.

A knitting rotor 131 (knitting element) according to the eighth embodiment differs from the knitting rotor 1 of the first embodiment in that the shape of a rotor 132 and a holder bearing 142 are different. More specifically, the rotor 132 differs from the rotor 2 of the first embodiment in that the engagement recess for engaging knitting yarn does not reach the inside of the rotating shaft and in that the shape of the rotating shaft in a front view is formed with a drum shape. The holder bearing 142 differs from the bearing 12 of the first embodiment in that the holder bearing 142 comprises a groove 144 (space through which the knitting yarn passes) which forms a space between itself and the rotor 132. Descriptions which are the same as those of the first embodiment are omitted.

The knitting rotor 131 according to the eighth embodiment comprises the rotor 132 which is capable of rotating about the axis $L_1$, as shown in FIG. 33. The rotor 132 is formed with a disc shape, for example, as shown in FIGS. 33 and 34.

The rotor 132 comprises a rotor shaft 133 (rotating shaft) which protrudes in both directions along the axis $L_1$ from a rotor main body (135). The amount of protrusion of the rotor shaft 133 in the direction of the axis $L_1$ is on the order of the sheet thickness of the rotor main body (135), for example. In the following description, parts which are formed jutting outward from the outer circumference of the rotor shaft 133 which is the rotor main body are referred to as the rotor blade 135.

A pair of hooks (engagement recesses) 136 are formed in the rotor blade 135 as recesses which are capable of engaging knitting yarn. A stitch loop is formed as a result of knitting yarn being engaged by these hooks 136 and the rotor 132 rotating about the axis $L_1$. The pair of hooks 136 are formed in opposite positions 180 degrees to each other. The hooks 136 are formed sinking from the circumferential face of the rotor 132 toward the core of the rotor 132. Furthermore, a large space which allows passage of the knitting yarn is formed between a bottom 137 of the hooks 136 and the holder bearing 142. The bottom 137 of the hooks 136 is formed extending outward from the outer circumferential face of the rotor shaft 133. The bottom 137 of the hooks 136 is formed over the entire width of the rotor shaft 133 in the direction of the axis $L_1$.

A pair of rotor guides 8 are formed in the rotor blade 135 as recesses which are utilized for rotationally drive the rotor 132.

The rotor shaft 133 has a drum shape in a front view (See FIG. 34) and the middle has a constricted shape. Furthermore, when a shaft which extends in a lateral direction in FIG. 34 is the X axis and a shaft which is orthogonal to the X axis and extends in a vertical direction in FIG. 34 is the Y axis, a longitudinal direction $L_4$ of the drum shape is inclined with respect to the Y axis (and X axis). The rotor shaft 133 comprises an arc-shaped circumferential face 133*a* capable of butting against the holder bearing 142 and inclined faces 133*b* and 133*c* which are formed facing inward from the rotational circumference (R) of the circumferential face 133*a*. Thus, a segmental part which sinks inward from the rotational circumference $R_4$ is formed by the rotor 132. The segmental part is, in a frontal view, an area which is enclosed by the inclined faces 133*b* and 133*c* and the rotational circumference $R_4$ and an area in which the rotor shaft 133 is not formed.

Furthermore, the inclined faces 133*b* and 133*c* are inclined at mutually different angles. The inclined face 133*b* is formed, in a front view, as a continuation from a wall face 136*a* of the hook 136 upstream in the rotational direction b. Furthermore, the bottom 137 of the hook 136 is formed to touch the rotational circumference $R_4$ of the circumferential face 133*a* of the rotor shaft 133.

The knitting rotor 131 comprises a holder 141 which supports the rotor 132 from both sides in the direction of the axis $L_1$. The holder 141 comprises a holder bearing 142 which rotatably supports the rotor 132. The holder bearing 142 is formed with an arc shape in order to follow the circumferential face 133*a* of the rotor shaft 133. An abutment face which butts against the circumferential face 133*a* of the rotor shaft 133 is formed on the inner circumferential side of the holder bearing 142. That is, the rotor shaft 133 slides and the rotor 132 rotates about the axis $L_1$.

The recess groove 144 is formed in the inner circumferential side of the holder bearing 142 as shown in FIG. 36. This groove 144 is formed continuously over the entire length of the holder bearing 142 in the circumferential direction. The groove 144 forms a space between the rotor shaft 133 and the holder bearing 142 and is able to pass knitting yarn.

Figure 37:
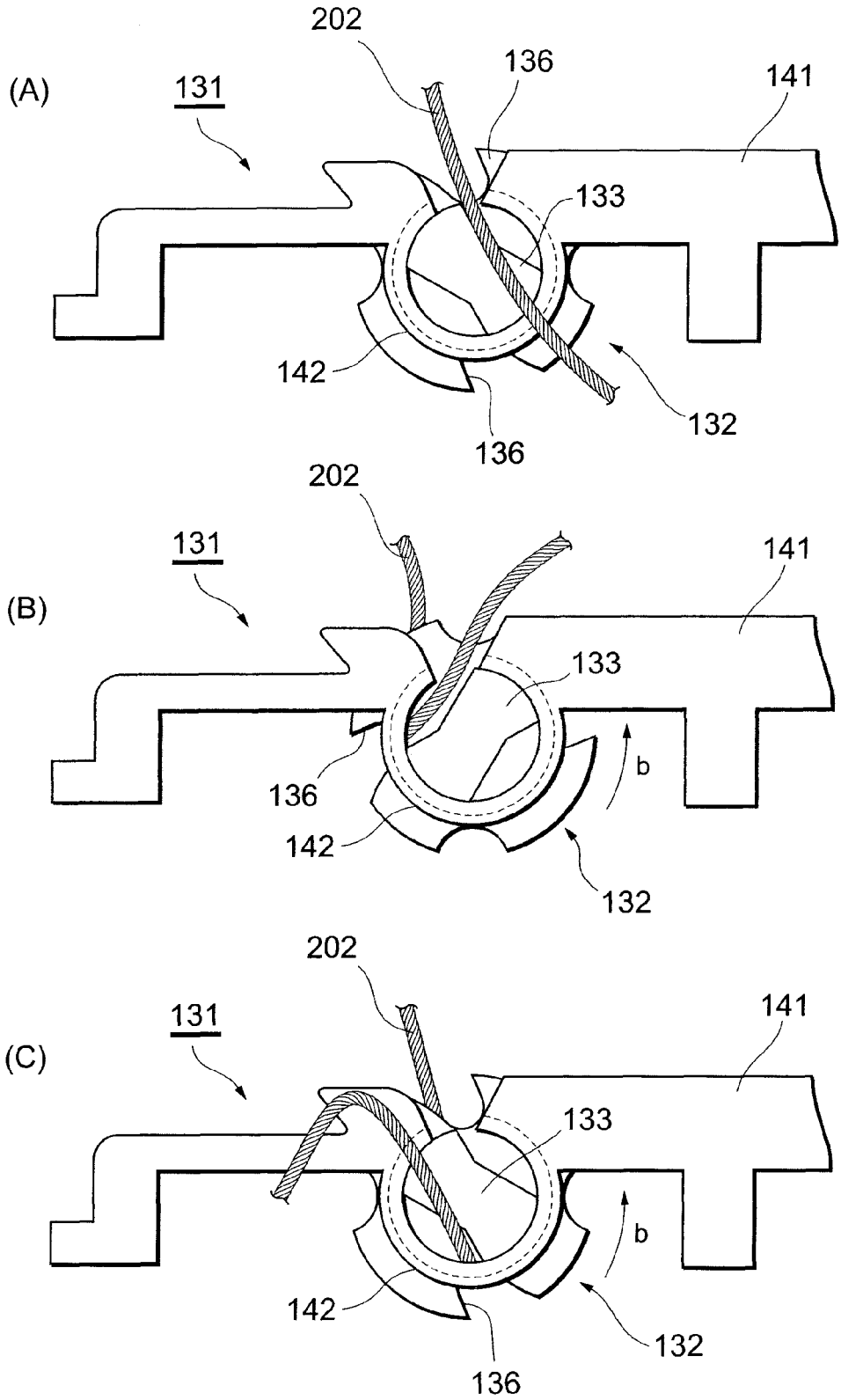
FIG. 37 shows a knitting cycle which employs the rotor according to the eighth embodiment of the present invention.

A knitting method which employs the rotational motion of the rotor 132 will be described next. FIG. 37 shows a knitting cycle which employs the rotor according to the eighth embodiment of the present invention. The rotor 132 operates by rotating in the direction of arrow b (in a negative direction in FIG. 37).

The process of making the position of the rotor 132 shown in (A) of FIG. 37 the reference rotation position (0 degree) will now be described. As shown in (A) of FIG. 37, when the rotor 132 is in the 0 degree position (origin), the knitting yarn 202 is supplied to the rotor 132. This is a state where an old loop (not shown) is engaged by the lower hook 136.

The rotor 132 starts to receive the knitting yarn by means of the upper hook 136 in rotating from the 0 degree position to a 45 degree position. That is, the knitting yarn starts to be hooked on the upper hook bottom 137.

The rotor 132 rotates 45 degrees from the 45 degree position and enters the state shown in (B) of FIG. 37. When the rotor 132 rotates from the 45 degree position to a 90 degree position, the knitting yarn 202 starts to pass through the old loop while forming a new loop. During the rotational motion of the rotor 132, the knitting yarn passes through the space formed between the holder bearing 142 and the rotor shaft 133, that is, the groove 144.

When the rotor 132 rotates from the 90 degree position to the 135 degree position, the new loop passes through the old loop.

The rotor 132 rotates 45 degrees from the 135 degree position and enters the state shown in (C) of FIG. 37. When the rotor 132 rotates from the 135 degree position to the 180 degree position, the passage of the new loop through the old loop is completed.

Further, with the rotor 132 in the 180 degree position, the sinker advances (toward the left in (C) of FIG. 37) and the old loop escapes from the hook 136. The stitch (loop) passes through both sides of the rotor shaft 133 during the rotation of the rotor 132.

This knitting rotor 131 of the eighth embodiment has the rotor shaft 133 provided on both sides of the rotor main body and is therefore easily rotationally driven. The rotor shaft 133 is also formed in a button shape with limited protrusion. It is therefore easy for a loop to pass through both sides of the rotor shaft 133.

With the rotor 132, because the bottom 137 of the hook 136 is formed outside the rotational circumference $R_4$ of the rotor shaft 133, the hook 136 is capable of easily forming a stitch which is large in comparison with that of the rotor 2 of the first embodiment in which the hook 6 is formed extending toward the inside of the rotor shaft 3.

The rotor 132 has a shallow engagement recess in comparison with that of the rotor 2 of the first embodiment and the strength of the rotor 132 itself can therefore be raised.

The present invention was described hereinabove in specific terms based on these embodiments. However, the present invention is not limited to these embodiments. Although these embodiments describe the application of a knitting rotor to a circular knitting machine, the knitting element (knitting rotor) of the present invention may also be applied to other knitting machines such as a flat-knitting machine or a warp-knitting machine, for example. The knitting element (knitting rotor) of the present invention is most suited to a knitting machine for manufacturing socks.

Although a spiral rail system and rack and pinion system were adopted as methods of driving the rotor in the embodiments above, the rotor driving method may also be another method. For example, the rotor may be rotated by utilizing a magnetic force or the rotation of the rotor may be controlled by an actuator which utilizes an electromagnet and a piezoelectric element.

Although the profile of the rotor main body was described as being circular in the embodiments above, the profile of the rotor main body may have a different shape. The number of hooks is not limited. A rotor may comprise three hooks or five or more hooks.

In addition, the rotor shaft is not necessarily circular and may instead have a semicircular shape, a drum shape, or a shape made by removing part of a circle.

As detailed earlier, the knitting element of the embodiment of the present invention allows rotors to rotate stably, permits independent rotational control of the rotors, and can be applied to a practical knitting machine.

The knitting machine of the embodiment of the present invention allows rotors to rotate stably, permits independent rotational control of the rotors, and can be applied to a practical knitting machine. The rotational position of the rotor about the rotating shaft can also be regulated in accordance with the orbit followed by the knitting element through cooperation with the guide portion and guided portion. Removing the knitting element unit is straightforward and maintenance is simplified.

The rotor of the knitting element of the embodiment of the present invention allows rotors to rotate stably, permits independent rotational control of the rotors, and allows a practical knitting element and knitting machine to be implemented.

The knitting method of the embodiment of the present invention allows a stitch to be made by using the rotational motion of the rotors.

What is claimed is:

1. A knitting element having a rotor capable of rotating about an axis, the knitting element making a stitch by using rotational motion of the rotor, the knitting element comprising:

the rotor having a rotating shaft protruding in a direction of the axis; and a bearing supporting a circumferential face of the rotating shaft slidably, wherein an engagement recess capable of engaging knitting yarn is formed in a circumferential face of the rotor, and wherein the engagement recess extends in an axial direction at least an entire axial length of the rotor excluding the rotating shaft.

2. A knitting element having a rotor capable of rotating about an axis, the knitting element making a stitch by using rotational motion of the rotor, the knitting element comprising:

the rotor having a rotating shaft protruding in a direction of the axis; and a bearing supporting a circumferential face of the rotating shaft slidably, wherein an engagement recess capable of engaging knitting yarn is formed in a circumferential face of the rotor, and wherein the engagement recess is formed facing toward a core of the rotor, a bottom of the engagement recess is formed inside the rotating shaft, and an opening which allows the knitting yarn to enter the bottom of the engagement recess is formed in the bearing.

3. The knitting element according to claim 1, wherein a guided portion for causing the rotor to rotate about the axis is formed at the circumferential face of the rotor.

4. A knitting element having a rotor capable of rotating about an axis, the knitting element making a stitch by using rotational motion of the rotor, the knitting element comprising:

the rotor having a rotating shaft protruding in a direction of the axis; and a bearing supporting a circumferential face of the rotating shaft slidably, wherein an engagement recess capable of engaging knitting yarn is formed in a circumferential face of the rotor, wherein a guided portion for causing the rotor to rotate about the axis is formed at the circumferential face of the rotor, and wherein a pair of the engagement recesses are formed in positions opposite one another, and a pair of guided portions are formed opposite one another in positions different from the positions in which the pair of the engagement recesses are formed.

5. A knitting machine, comprising:

a knitting element having a rotor capable of rotation about a first axis, the knitting element making a stitch by using rotational motion of the rotor; and a base having a knitting element holding portion which holds the knitting element, the base causing the knitting element to rotate about a second axis orthogonal to the first axis, wherein the knitting element comprises the rotor having a rotating shaft protruding in a direction of the first axis, and a bearing supporting a circumferential face of the rotating shaft slidably, and wherein an engagement recess capable of engaging knitting yarn is formed in a circumferential face of the rotor.

6. The knitting machine according to claim 5, wherein the engagement recess is formed facing toward a core of the rotor, a bottom of the engagement recess is formed inside the rotating shaft, and an opening which allows the knitting yarn to enter the bottom of the engagement recess is formed in the bearing.

7. The knitting machine according to claim 5, further comprising:

a guide portion, disposed so as to correspond to an orbit of the rotor centered on the second axis, the guide portion regulating a rotational position of the rotor about the first axis, wherein a guided portion to be guided by the guide portion is formed at the circumferential face of the rotor.

8. The knitting machine according to claim 7, wherein the guide portion is a rail protruding toward the rotor, and the guided portion is a guide recess guided by the rail.

9. The knitting machine according to claim 7, wherein the guide portion is a groove deepening toward the side opposite to the rotor, and the guided portion is a guide protrusion guided by the groove.

10. The knitting machine according to claim 5, wherein a pair of the engagement recesses are formed in positions opposite one another, and a pair of the guided portions are formed opposite one another in positions different from the positions in which the pair of the engagement recesses are formed.

11. A rotor for a knitting element making a stitch by using rotational motion, comprising:

a rotor main body, wherein an engagement recess capable of engaging knitting yarn is formed in a circumferential face of the rotor main body; and a rotating shaft provided at a core of the rotor main body, the rotating shaft protruding outward, wherein the engagement recess extends in an axial direction at least an entire axial length of the rotor excluding the rotating shaft.

12. The rotor for a knitting element according to claim 11, wherein the engagement recess is formed facing toward the core, and a bottom of the engagement recess is formed inside the rotating shaft.

13. A rotor for a knitting element making a stitch by using rotational motion, comprising:

a rotor main body, wherein an engagement recess capable of engaging knitting yarn is formed in a circumferential face of the rotor main body; and a rotating shaft provided at a core of the rotor main body, the rotating shaft protruding outward; and a pair of the rotor main bodies disposed opposite one another and spaced apart in an axial direction.

14. A rotor for a knitting element making a stitch by using rotational motion, comprising:

a rotor main body, wherein an engagement recess capable of engaging knitting yarn is formed in a circumferential face of the rotor main body; and a rotating shaft provided at a core of the rotor main body, the rotating shaft protruding outward; and a spring hook protruding outward from the circumferential face of the rotor main body, the spring hook being capable of sliding in a circumferential direction, wherein the spring hook is able to slide in the circumferential direction and modify width of an opening of the engagement recess.

15. A knitting method using a knitting element employing rotational motion of a rotor, the rotor having a rotor main body wherein a first engagement recess and a second engagement recess capable of engaging knitting yarn are formed in a circumferential face of the rotor main body, and a rotating shaft provided at a core of the rotor main body, the rotating shaft protruding outward, the knitting method comprising:

engaging a first knitting yarn with the first engagement recess to form an old loop;

passing the second engagement recess through the old loop while the second engagement recess engages a second knitting yarn to form a new loop, due to the rotational motion of the rotor, and a step of making a stitch, after the step of passing through the old loop, by the old loop that escapes from the first engagement recess as a result of the first and second knitting yams passing outside from both ends of the rotating shaft, respectively.

* * * * *